US009437127B2

(12) United States Patent
Park et al.

(10) Patent No.: US 9,437,127 B2
(45) Date of Patent: Sep. 6, 2016

(54) DEVICE AND METHOD FOR DISPLAYING IMAGE, DEVICE AND METHOD FOR SUPPLYING POWER, AND METHOD FOR ADJUSTING BRIGHTNESS OF CONTENTS

(71) Applicant: SAMSUNG ELECTRONICS CO., LTD., Suwon-si (KR)

(72) Inventors: Jae-sung Park, Anyang-si (KR); Hyung-rae Kim, Seoul (KR); Myoung-jun Lee, Bucheon-si (KR); Sang-hoon Lee, Suwon-si (KR); Byeong-cheol Hyeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 369 days.

(21) Appl. No.: 13/719,597

(22) Filed: Dec. 19, 2012

(65) Prior Publication Data

US 2013/0169697 A1 Jul. 4, 2013

(30) Foreign Application Priority Data

| | | |
|---|---|---|
| Dec. 28, 2011 | (KR) | 10-2011-0144712 |
| Dec. 28, 2011 | (KR) | 10-2011-0144731 |
| Dec. 28, 2011 | (KR) | 10-2011-0144944 |
| Dec. 30, 2011 | (KR) | 10-2011-0147488 |
| Jan. 2, 2012 | (KR) | 10-2012-0000293 |
| Jun. 5, 2012 | (KR) | 10-2012-0060421 |

(51) Int. Cl.

| | |
|---|---|
| ***G09G 3/20*** | (2006.01) |
| ***G09G 3/00*** | (2006.01) |
| ***G09G 3/32*** | (2016.01) |

(52) U.S. Cl.

CPC ..... *G09G 3/2003* (2013.01); *G09G 3/003* (2013.01); *G09G 3/2081* (2013.01); (Continued)

(58) Field of Classification Search

CPC ..... G09G 3/2003; G09G 3/20; G09G 5/02; G09G 5/10; G09G 5/00

USPC ..... 345/690, 88, 89, 590, 428

See application file for complete search history.

(56) References Cited

U.S. PATENT DOCUMENTS

| | | | | |
|---|---|---|---|---|
| 7,012,591 | B2 * | 3/2006 | Chen et al. | 345/88 |
| 7,071,906 | B2 | 7/2006 | Nishitani et al. | |

(Continued)

FOREIGN PATENT DOCUMENTS

| | | | |
|---|---|---|---|
| CN | 1763821 | A | 4/2006 |
| CN | 1953027 | A | 4/2007 |

(Continued)

OTHER PUBLICATIONS

Communication from the European Patent Office issued Jun. 12, 2014 in a counterpart European Application No. 12196695.6.

(Continued)

*Primary Examiner* — Fred Tzeng

(74) *Attorney, Agent, or Firm* — Sughrue Mion, PLLC

(57) ABSTRACT

A device and a method for displaying an image, a device and a method for supplying power, and a method for adjusting brightness of contents are provided. The device for displaying the image includes: a pixel value converter which, if a plurality of color pixel values of the image is received, converts the received color pixel values; a display panel which includes a plurality of color light-emitting devices and which drives each of the plurality of color light-emitting devices based on the converted color pixel values; a light-emission controller which provides the display panel with a control signal which variably controls respective driving times of each of the color light-emitting devices based on colors; and a global controller which controls the light-emission controller to variably adjust a duty ratio of the control signal based on colors and the converted color pixel values.

15 Claims, 27 Drawing Sheets

(52) U.S. Cl.
CPC ... *G09G 3/3233* (2013.01); *G09G 2300/0861* (2013.01); *G09G 2320/0252* (2013.01); *G09G 2320/0271* (2013.01); *G09G 2320/041* (2013.01); *G09G 2320/0626* (2013.01); *G09G 2330/021* (2013.01); *G09G 2330/028* (2013.01); *G09G 2340/16* (2013.01); *G09G 2360/16* (2013.01)

(56) References Cited

U.S. PATENT DOCUMENTS

| | | | | |
|---|---|---|---|---|
| 7,184,008 | B2 * | 2/2007 | Baba et al. | 345/88 |
| 7,312,776 | B2 * | 12/2007 | Bu | 345/88 |
| 7,453,475 | B2 * | 11/2008 | Nitta et al. | 345/690 |
| 7,468,732 | B2 * | 12/2008 | Okada | 345/589 |
| 7,916,112 | B2 | 3/2011 | Peng et al. | |
| 8,354,986 | B2 * | 1/2013 | Lin et al. | 345/88 |
| 2003/0142048 | A1 | 7/2003 | Nishitani et al. | |
| 2005/0007392 | A1 | 1/2005 | Kasai et al. | |
| 2006/0158411 | A1 * | 7/2006 | Sakashita | 345/89 |
| 2007/0085780 | A1 | 4/2007 | Peng et al. | |
| 2007/0182672 | A1 | 8/2007 | Hoppenbrouwers et al. | |
| 2008/0018632 | A1 | 1/2008 | Cordes et al. | |
| 2008/0101556 | A1 | 5/2008 | Kim et al. | |
| 2008/0266315 | A1 * | 10/2008 | Im et al. | 345/590 |
| 2009/0051708 | A1 | 2/2009 | Ko | |
| 2009/0219306 | A1 * | 9/2009 | Oh et al. | 345/690 |
| 2010/0079502 | A1 * | 4/2010 | Moroney | 345/690 |
| 2010/0127957 | A1 | 5/2010 | Meguro et al. | |
| 2011/0134125 | A1 * | 6/2011 | Chen | 345/428 |
| 2011/0134150 | A1 * | 6/2011 | Imamura | 345/690 |
| 2013/0088506 | A1 * | 4/2013 | Yun et al. | 345/589 |
| 2013/0321477 | A1 * | 12/2013 | Gandhi et al. | 345/690 |

FOREIGN PATENT DOCUMENTS

| | | | |
|---|---|---|---|
| KR | 10-2008-0038896 | A | 5/2008 |
| KR | 10-2010-0011786 | A | 2/2010 |

OTHER PUBLICATIONS

Communication dated Feb. 21, 2013 issued by the Korean Patent Office in counterpart Korean Patent Application No. 10-2012-0058340.

Communication from the State Intellectual Property Office of P.R. China dated Feb. 15, 2016 in a counterpart Chinese application No. 201210574299.2.

* cited by examiner

700

| OUTPUT | INPUT |
|---|---|
| 1A | 0.1V |
| 2A | 0.2V |
| 3A | 0.3V |
| 4A | 0.4V |

(a)

(b)

DEVICE AND METHOD FOR DISPLAYING IMAGE, DEVICE AND METHOD FOR SUPPLYING POWER, AND METHOD FOR ADJUSTING BRIGHTNESS OF CONTENTS

CROSS-REFERENCE TO RELATED APPLICATION(S)

This application claims priority under 35 U.S.C. §119 from Korean Patent Applications Nos. 10-2011-0144944, 10-2011-0144712, 10-2011-0144731, 10-2012-0000293, 10-2011-0147488, and 10-2012-0060421, respectively filed on Dec. 28, 2011, Dec. 28, 2011, Dec. 28, 2011, Jan. 2, 2012, Dec. 30, 2011, and Jun. 5, 2012, in the Korean Intellectual Property Office, the disclosure of each of which is incorporated herein by reference in its entirety.

BACKGROUND

1. Field

Exemplary embodiments disclosed herein generally relate to a device and a method for displaying an image, a device and a method for supplying power, and a method for adjusting brightness of contents, and more particularly, to a device and a method for displaying an image, by which driving power supplied to an organic light-emitting diode (OLED) panel is feed-forward-controlled based on an image signal supplied to the OLED panel, a heat emission caused by a voltage difference is reduced during driving of red (R), green (G), and blue (B) light-emitting devices by using a power supply voltage VDD, R, G, and B values of image frame data are respectively checked to calculate a maximum current value, a direct current (DC) voltage is converted into a DC voltage having a voltage level corresponding to the maximum current value, power having different amplitudes is supplied according to colors of OLEDs of pixels or a plurality of pixel groups, and a plurality of contents are provided on a screen, a device and a method for supplying power, and a method for adjusting brightness of contents.

2. Description of the Related Art

An image display device processes and displays digital or analog image signals received from an external source and various types of image signals stored in various types of compression formats in an internal storage device.

Organic light-emitting display devices have been actively developed. Such an organic light-emitting display device is a kind of flat panel display and uses an organic light-emitting diode (OLED). In particular, the OLED refers to a self-emission type of organic material which self-emits light by using an electroluminescent phenomenon in which a current flows in an organic compound to emit light. The organic light-emitting display device is driven at a low voltage, is formed as thin film type, and has a wide viewing angle and a fast response speed. Therefore, the organic light-emitting display device does not change an image quality even on a side, and does not leave an afterimage differently from a general liquid crystal display (LCD). If the organic light-emitting display device has a small-sized screen, the organic light-emitting display device has an advantageous competitive price due to a higher image quality and a simpler manufacturing process than the general LCD.

Although not shown in the drawings, the organic light-emitting display device has a structure in which R, G, and B OLEDs are arranged between a single power supply voltage VDD supplied from a power supply terminal and a ground voltage Vss of a power ground terminal, and switch elements such as field effect transistors (FETs) are connected between the R, G, and B OLEDs and the power supply voltage VDD.

In particular, the R, G, and B OLEDs have different driving voltages which vary based on their respective colors, and thus different voltages of both ends are applied to the switching elements respectively connected to the R, G, and B OLEDs according to colors. For example, if a single power supply voltage is 6V, and the R and G OLEDs are respectively driven at voltages of 3V and 4V, a voltage obtained by subtracting 3V from power supply voltage 6V is applied to both ends of the switching element connected to the R OLED. In addition, a voltage obtained by subtracting 4V from a power supply voltage is applied to both ends of the switching element connected to the G OLED.

However, in the organic light-emitting display device, brightness of an image may vary based on a level of a driving voltage. Therefore, a driving voltage supplied to OLEDs in a transition section greatly drops due to a pulse form zone current OLED load characteristic, and brightness of an image may be distorted when the driving voltage greatly drops.

Further, a voltage applied to the switching elements is also referred to as a headroom voltage. Heat is generated due to a difference of the headroom voltage, and thus efficiency of a whole system is deteriorated.

For example, a fixed power supply voltage ELVDD of 12V is supplied as first power ELVDD, which is supplied to a plurality of pixels of the organic light-emitting display device. However, if the fixed power supply voltage ELVDD of 12V is supplied in a situation that R, G, and B values are low gradations (i.e., if a current applied to the OLEDs is a low current), the headroom voltage applied to the switching elements does not reflect R, G, and B gradation levels. Therefore, a large amount of power is consumed in the switching elements due to heat.

In addition, the organic light-emitting display device has a 3-step power conversion structure in order to supply the first power ELVDD which is supplied to the plurality of pixels. In particular, a voltage supply unit has a 3-step power conversion structure including a power factor correction (PFC), a 24V DC/DC converter, and a 12V DC/DC converter which are connected to one another in series. Therefore, first power ELVDD of 12V is supplied to a panel unit of the organic light-emitting display device.

However, in this example, the PFC has power efficiency of about 95%, the 24V DC/DC converter has power efficiency of about 92%, the 12V DC/DC converter has power efficiency of about 94%, and the panel unit has power efficiency of about 80%. Therefore, the organic light-emitting display device has total power efficiency of about 65.7%. Hence, the 3-step power conversion structure causes a large amount of power loss. Further, since the organic light-emitting display device has the 3-step power conversion structure, small-sizing of circuits is limited.

Image display devices have provided various types of contents to satisfy demands of users. Therefore, there have been developed image display devices which simultaneously provide a plurality of contents to allow a plurality of users to view different types of contents. If such an image display device is used, a plurality of users may individually select and view desired contents by using one image display device. Contents displayable in an image display device may include, for example, a broadcast receiving screen, various types of program execution screens, and/or other types of displayable contents. The users input content change commands to view their contents in order to view new contents.

However, if a brightness adjusting method such as an existing adaptive brightness limiter (ABL) is applied to each of image frames of a plurality of contents, it is difficult to realize brightness and an image quality corresponding to each of the contents. If a display panel including a self-emission display device such as an organic light-emitting display device is used, this problem causes a switching mode power supply (SMPS) load problem, thereby deteriorating a performance of the self-emission display device.

SUMMARY

Exemplary embodiments address at least the above problems and/or disadvantages and other disadvantages not described above. However, the exemplary embodiments are not required to overcome the disadvantages described above, and an exemplary embodiment may not overcome any of the problems described above.

The exemplary embodiments provide a device for displaying an image, and a device and a method for supplying power, by which a driving voltage supplied to an organic light-emitting diode (OLED) panel is feed-forward-controlled based on an image signal provided to the OLED panel.

The exemplary embodiments also provide a device and a method for displaying an image, by which headroom voltages become similar to one another based on color light-emitting devices, and each color duty is adjusted to correct original gradation and brightness.

The exemplary embodiments also provide a device and a method for supplying power, and a device for displaying an image, by which R, G, and B values of image frame data are respectively checked to calculate a maximum current value, a direct current (DC) voltage is converted to a DC voltage having a voltage level corresponding to the maximum current value, and the DC voltage is supplied in order to increase power efficiency.

The exemplary embodiments also provide a device and a method for supplying power, and a device for displaying an image, by which a buildup time required for a conversion job between voltage levels necessary for consecutive frames is estimated to increase power efficiency.

The exemplary embodiments also provide a device and a method for supplying power, and a device for displaying an image, by which an effect of a rise in a temperature of an OLED is considered to increase power efficiency, and an accurate gradation representation is possible.

The exemplary embodiments also provide a device and a method for displaying an image, by which a voltage supply unit has a 2-step power conversion structure, power having different amplitudes is supplied based on colors of OLEDs of pixels or a plurality of pixel groups to increase whole power efficiency of a system, and a circuit is small-sized.

The exemplary embodiments also provide a device for displaying an image and a method for adjusting brightness, by which an additional brightness adjustment is performed with respect to brightness of each of a plurality of contents.

According to an aspect of the exemplary embodiments, there is provided a device for displaying an image. The device may include: an organic light-emitting diode (OLED) panel unit which receives an image signal and driving power to display the image; an image signal provider which provides the image signal to the OLED panel unit; and a voltage supply unit which supplies driving power to the OLED panel unit and performs a feed-forward control with respect to the driving power based on the image signal.

The voltage supply unit may estimate a driving current, which is to be supplied to the OLED panel unit, based on brightness information relating to the image signal, and may perform the feed-forward control with respect to the driving power based on the estimated driving current.

The brightness information may include information relating to a light-emission level of the OLED panel unit and timing information to which the light-emission level is applied.

The voltage supply unit may output the driving power corresponding to the brightness information at a timing corresponding to the brightness information by using a lookup table (LUT) which stores a respective plurality of driving current values in conjunction with a corresponding plurality of light-emission levels of the OLED panel unit.

The device may further include a cable which supplies the driving power from the voltage supply unit to the OLED panel unit. The voltage supply unit may perform a feedback control with respect to the driving voltage based on a voltage of a node that the cable and the OLED panel unit commonly contact, and may perform the feed-forward control with respect to the driving power based on the image signal.

The voltage supply unit may include: a rectifier which rectifies external alternating current (AC) power to direct current (DC) power; a transformer which transforms the rectified DC power to output driving power; a switching unit which selective supplies the rectified DC power to the transformer; and a power controller which controls the switching unit to perform the feed-forward control with respect to the driving power output from the transformer based on the image signal.

The power controller may perform the feedback control with respect to the driving voltage of the driving power output from the transformer, and may perform the feed-forward control based on the image signal.

The power controller may further include a cable which supplies the driving power from the voltage supply unit to the OLED panel unit. The power controller may perform a feedback control with respect to a voltage of a node that the cable and the OLED panel unit commonly contact, and may perform the feed-forward control based on the image signal.

According to another aspect of the exemplary embodiments, there is provided a device for supplying driving power to an OLED panel. The device may include: a rectifier which rectifies external AC power to DC power; a transformer which transforms the rectified DC power to output the DC power as driving power to the OLED panel unit; a switching unit which selectively supplies the rectified DC power to the transformer; an input which receives an image signal which is supplied to the OLED panel; and a power controller which controls the switching unit to perform a feed-forward control with respect to the driving power outputted from the transformer based on the received image signal.

The power controller may estimate a driving current, which is to be supplied to the OLED panel, based on brightness information relating to the image signal, and may control the switching unit based on the estimated driving current.

The brightness information may include information relating to a light-emission level of the OLED panel and timing information to which the light-emission level is applied.

The power controller may output the driving power corresponding to the brightness information at a timing corresponding to the brightness information by using a LUT which stores a respective plurality of driving current values in conjunction with a corresponding plurality of light-emission levels of the OLED panel.

The power controller may perform a feedback control with respect to a driving voltage of the driving power output from the transformer, and may perform the feed-forward control based on the image signal.

The power controller may perform a feedback control with respect to a voltage of a node that a cable supplying the driving power to the OLED panel and the OLED panel commonly contacts, and may perform the feed-forward control based on the image signal.

According to another aspect of the exemplary embodiments, there is provided a method for supplying driving power to an OLED panel. The method may include: rectifying external AC power to DC power; selectively outputting the rectified DC power; transforming the selectively output DC power to output the transformed DC power as driving power to the OLED panel; receiving an image signal which is provided to the OLED panel; and performing a feed-forward control with respect to the driving power based on the received image signal.

A driving current to be supplied to the OLED panel may be estimated based on brightness information relating to the image signal, and the feed-forward control may be performed based on the estimated driving current.

The brightness information may include information relating to a light-emission level of the OLED panel and timing information to which the light-emission level is applied.

The driving power corresponding to the brightness information may be outputted at a timing corresponding to the brightness information by using a LUT which stores a respective plurality of driving current values in conjunction with a corresponding plurality of light-emission levels of the OLED panel.

The feedback control may be performed with respect to the driving voltage of the transformed and may output driving power, and the feed-forward control may be performed based on the image signal.

A feedback control may be performed with respect to a voltage of a node that a cable supplying the driving power to the OLED panel and the OLED panel commonly contacts, and the feed-forward control may be performed based on the image signal.

According to another aspect of the exemplary embodiments, there is provided a device for displaying an image. The device may include: a pixel value converter which, if a plurality of color pixel values of the image is received, converts the received color pixel values; a display panel which includes a plurality of color light-emitting devices and which drives each of the plurality of color light-emitting devices based on the converted color pixel values; a light-emission controller which provides the display panel with a control signal which variably controls respective driving times of each of the color light-emitting devices based on colors; and a global controller which controls the light-emission controller to variably adjust a duty ratio of the control signal based on colors and the converted color pixel values.

The plurality of color light-emitting devices may include a red (R) light-emitting device, a green (G) light-emitting device, and a blue (B) light-emitting device, and the plurality of color pixel values may include an R pixel value, a G pixel value, and a B pixel value.

The pixel value converter may store each of the respective converted color pixel values in conjunction with the corresponding received color pixel values in a lookup table (LUT) form.

The global controller may include a conversion value calculator which calculates respective differences between each respective one of the received color pixel values and each corresponding one of the converted color pixel values.

The light-emission controller may adjust the duty ratio of the control signal such that each of the color light-emitting devices has a long turn-on time in correspondence with an order of a respective magnitude of a driving voltage of each of the color light-emitting devices.

If the color light-emitting devices are an R color light-emitting device, a G color light-emitting device, and a B color light-emitting device, the light-emission controller may generate the control signal such that the respective turn-on times satisfy an equation expressible as:

$$ix_org \times Dx_org = ix_calc \times Dx_calc$$

wherein ix_org denotes a current value corresponding to a received pixel value, Dx_org denotes a turn-on time of the respective color light-emitting device which corresponds to the received pixel value, ix_calc denotes a current value calculated by the global controller, Dx_calc denotes a turn-on time calculated by the global controller, and x can be equal to each of R, G, and B.

Each of the color light-emitting devices may be driven by a power supply voltage.

The display panel may include: a first switching element which is supplied with the power supply voltage to generate a current by using the converted color pixel values; and a second switching element which adjusts an amount of the current based on the control signal having the adjusted duty ratio and which supplies the current to each of the color light-emitting devices.

A respective conversion degree of each of the converted color pixel values may be determined based on a corresponding degree of lowering and setting a voltage of a switching element connected between the power supply voltage and the color light-emitting devices.

According to another aspect of the exemplary embodiments, there is provided a method for displaying an image. The method may include: if a plurality of color pixel values of an image is received, converting and outputting the received color pixel values; driving each of a plurality of color light-emitting devices based on the converted color pixel values by using a display panel comprising the plurality of color light-emitting devices; providing a control signal from a light-emission controller to the display panel, wherein the control signal variably controls respective driving times of each of the color light-emitting devices; and controlling the light-emission controller to variably adjust a duty ratio of the control signal based on colors and the converted color pixel values.

Each of the respective converted color pixel values may be stored in conjunction with each corresponding received color pixel in a LUT form and outputted.

The converting and outputting of the input color pixel values may include: calculating respective differences between each respective received color pixel value and each corresponding one of the converted color pixel values. The light-emission controller may generate a control signal which variably controls the respective driving times according to colors based on a corresponding result of the calculating.

The light-emission controller may be controlled to adjust the duty ratio such that each of the color light-emitting devices has a long turn-on time in correspondence with an order of a respective magnitude of a driving voltage of each of the color light-emitting devices.

If the color light-emitting devices are an R color light-emitting device, a G color light-emitting device, and a B color light-emitting device, the light-emission controller may generate the control signal such that the turn-on times satisfy an equation expressible as:

$$ix_org \times Dx_org = ix_calc \times Dx_calc$$

wherein ix_org denotes a current value corresponding to a received pixel value, Dx_org denotes a turn-on time of the respective color light-emitting device which corresponds to the received pixel value, ix_calc denotes a current value calculated by a global controller, Dx_calc denotes a turn-on time calculated by the global controller, and x can be equal to each of R, G, and B.

According to another aspect of the exemplary embodiments, there is provided a device for supplying power to a panel unit which includes a plurality of pixels which include OLEDs. The device may include: a voltage supply unit which supplies a DC voltage to the panel unit; a receiver which receives image frame data; and a controller which controls the voltage supply unit to respectively check R, G, and B values of the image frame data in order to calculate a maximum current value, convert the supplied DC voltage to a DC voltage having a voltage level corresponding to the calculated maximum current value, and supply the converted DC voltage to the panel unit.

The controller may control the voltage supply unit to respectively calculate maximum current values corresponding to R, G, and B values of two consecutive image frames, calculate a difference between voltage levels corresponding to the maximum current values, estimate a buildup time required for a conversion job between the voltage levels, and start the conversion job before the buildup time based on an output timing of the back one of the two consecutive image frames.

The controller may control the voltage supply unit to correct the maximum current value based on temperature information relating to the panel unit, convert the supplied DC voltage to a DC voltage having a voltage level corresponding to the corrected maximum current value, and supply the converted DC voltage to the panel unit.

The voltage supply unit may include: a power factor correction (PFC) unit which corrects a power factor of an input voltage; and a DC/DC converter which converts an output DC voltage of the PFC unit to the converted DC voltage and supplies the converted DC voltage to the panel unit.

The device may further include a storage unit. The controller may control the storage unit to store the maximum current value corrected based on the temperature information, a voltage level corresponding to the corrected maximum current value, and the buildup time.

According to another aspect of the exemplary embodiments, there is provided a method for supplying power to a panel unit which includes a plurality of pixels which include OLEDs. The method may include: receiving image frame data; respectively checking R, G, B values of the image frame data to calculate a maximum current value; converting an output DC voltage to a DC voltage having a voltage level corresponding to the maximum current value by using the calculated maximum current value; and supplying the converted DC voltage to the panel unit.

The method may further include: calculating maximum current values corresponding to R, G, and B values of two consecutive image frames and calculating a difference between voltage levels corresponding to the maximum current values to estimate a buildup time required for a conversion job between the voltage levels. The conversion job may be performed before the buildup time based on an output timing of the back one of the two consecutive image frames.

The method may further include: correcting the maximum current values based on temperature information relating to the panel unit. The output DC voltage may be converted to a DC voltage having a voltage level corresponding to the corrected maximum current values.

The method may further include: correcting a power factor of an input DC voltage; and converting the DC voltage having the corrected power factor to the output DC voltage and supplying the output DC voltage to the panel unit.

The method may further include: storing the maximum current values corrected based on the temperature information, the voltage levels corresponding to the corrected maximum current values, and the buildup time.

According to another aspect of the exemplary embodiments, there is provided a device for displaying an image. The device may include: an interface unit which receives an image signal; a panel unit which includes a plurality of pixels which include OLEDs and displays an image frame corresponding to the received image signal; a voltage supply unit which supplies a DC voltage to the panel unit; and a controller which controls the voltage supply unit to respectively check R, G, and B values of image frame data corresponding to the image signal to calculate a maximum current value, convert the supplied DC voltage to a DC voltage having a voltage level corresponding to the maximum current value, and supply the converted DC voltage to the panel unit.

The controller may control the voltage supply unit to respectively calculate maximum current values corresponding to R, G, and B values of two consecutive image frames, calculate a difference between voltage levels corresponding to the maximum current values, estimate a buildup time required for a conversion job between the voltage levels, and start the conversion job before the buildup time based on an output timing of the back one of the two consecutive image frames.

The device may further include a sensor which senses a temperature of the panel unit. The controller may control the voltage supply unit to correct the maximum current values based on the sensed temperature information, convert the supplied DC voltage to a DC voltage having a voltage level corresponding to the corrected maximum current values, and supply the converted DC voltage to the panel unit.

The voltage supply unit may include: a PFC unit which corrects a power factor of an input voltage; and a DC/DC converter which converts an output DC voltage of the PFC unit to the DC voltage and supplies the converted DC voltage to the panel unit.

The device may further include a storage unit. The controller may control the storage unit to store the maximum current value corrected based on the temperature information, a voltage level corresponding to the corrected maximum current value, and the buildup time.

The device may further include: a scan driver which supplies a scan signal to the plurality of pixels; and a data driver which supplies a data signal to the plurality of pixels.

According to another aspect of the exemplary embodiments, there is provided a device for displaying an image. The device may include: an interface unit which receives an image signal; a panel unit which includes a plurality of pixels which include OLEDs; and a panel driver which simultaneously supplies a plurality of powers having different levels to the panel unit to drive the panel unit in order to display an image frame corresponding to the received image signal.

The panel driver may supply the powers having different levels to the panel unit based on colors of the OLEDs of the pixels.

The panel driver may supply first power to a pixel including an R OLED and second power larger than the first power to a pixel including a B OLED.

The panel driver may supply power between the first and second powers to a pixel including a G OLED.

The device may further include: a controller which controls the panel driver to divide the plurality of pixels into a plurality of pixel groups and to selectively supply powers having different levels to each respective one of the plurality of pixel groups based on the received image signal.

The controller may control the panel driver to detect a gradation value of each pixel displaying an image frame of the received image signal to determine a respective level of power supplied to each of the pixel groups based on a size of the gradation value, and to supply the power having the determined respective level to each corresponding one of the pixel groups.

The panel driver may include a voltage supply unit which supplies the plurality of powers having the different levels. The voltage supply unit may include: a PFC unit which receives power and corrects a power factor of the received power; a DC/DC converter which converts the power having the corrected power factor to a plurality of powers, and a switching unit which switches an output of the DC/DC converter.

The panel driver may include: a scan driver which provides a scan signal to the each respective one of the plurality of pixels; and a data driver which provides a data signal to each respective one of the plurality of pixels.

According to another aspect of the exemplary embodiments, there is provided a method for displaying an image of an image display device including a panel unit which includes a plurality of pixels which include OLEDs. The method may include: receiving an image signal; simultaneously supplying a plurality of powers having different levels to the panel unit; and displaying an image frame corresponding to the received image signal on the panel unit.

The plurality of powers having the different levels may be supplied to the panel unit based on colors of the OLEDs of the pixels.

A first power may be supplied to a pixel including an R OLED, and a second power having a level larger than a corresponding level of the first power may be supplied to a pixel including a B OLED.

A power having a level between the respective levels of the first and second powers may be supplied to a pixel including a G OLED.

The method may further include: dividing the plurality of pixels into a plurality of pixel groups. The powers having the different levels may be selectively supplied to the plurality of pixel groups based on the received image signal.

A gradation value of each pixel displaying an image frame of the received image signal may be detected, a level of power supplied to each of the pixel groups may be determined based on a size of the gradation value, and the power having the determined level may be supplied to each of the pixel groups.

The simultaneously supplying the plurality of powers having the different levels may include: receiving power and correcting a power factor of the power; converting the power having the corrected power factor to the plurality of powers; and switching the plurality of powers.

The method may further include: providing a scan signal to each of the plurality of pixels; and providing a data signal to each of the plurality of pixels.

According to another aspect of the exemplary embodiments, there is provided a device for displaying an image. The device may include: a plurality of image processors which respectively detect brightness information relating to respective image frames of each of a corresponding plurality of contents and which adjust a respective brightness of the respective image frame of each corresponding one of the plurality of contents by using a brightness adjustment gain having a size corresponding to a magnitude relating to the brightness information; a MUX which multiplexes the image frames outputted from each of the plurality of image processors; and a display unit which displays the plurality of contents based on data outputted from the MUX.

The device may further include a data divider which receives the plurality of contents combined in an image frame unit to divide the image frames from the plurality of contents, and which provides the image frames to the plurality of image processors.

The plurality of image processors may include: detectors which detect brightness information relating to the image frames of the plurality of contents; calculators which calculate respective brightness adjustment gains having respective sizes corresponding to the detected brightness information; and converters which adjust respective brightnesses of the image frames based on the calculated brightness adjustment gains.

The plurality of image processors may adjust the brightnesses of the image frames of the plurality of contents based on at least one of an adaptive brightness limiter (ABL) and an adaptive picture level control (APC).

The display unit may include a plurality of self-light-emitting display devices.

According to another aspect of the exemplary embodiments, there is provided a method for adjusting brightnesses of contents of an image display device. The method may include: adjusting brightnesses of respective image frames of a plurality of contents by using brightness adjustment gains corresponding to brightness information relating to the respective image frames of the plurality of contents; multiplexing the image frames having the adjusted brightnesses; and displaying the multiplexed image frames.

The method may further include: receiving the plurality of contents combined in an image frame unit and dividing the image frames from the plurality of contents.

The adjusting of the brightnesses may include: detecting brightness information relating to the image frames of the contents; calculating the brightness adjustment gains having respective sizes corresponding to the detected brightness information; and adjusting the brightness of each of the image frames based on the calculated brightness adjustment gains.

The brightness of the image frames of the plurality of contents may be adjusted based on at least one of an ABL and an APC.

The multiplexed image frames may be displayed by using a plurality of self-light-emitting display devices.

BRIEF DESCRIPTION OF THE DRAWINGS

The above and/or other aspects will be more apparent by describing certain exemplary embodiments with reference to the accompanying drawings, in which.

DETAILED DESCRIPTION OF THE EXEMPLARY EMBODIMENTS

Figure 1:
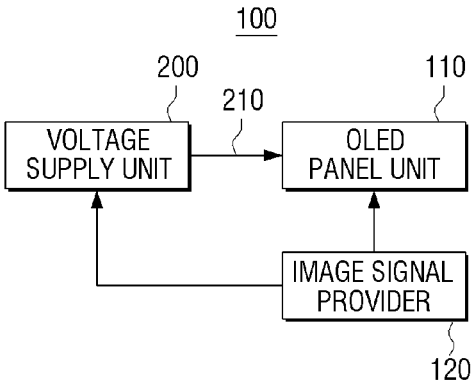
FIG. 1 is a block diagram which illustrates a simple structure of a device for displaying an image according to an exemplary embodiment.

Exemplary embodiments are described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Further, well-known functions or constructions are not described in detail since they would obscure the exemplary embodiments with unnecessary detail.

FIG. 1 is a block diagram which illustrates a simple structure of a device 100 for displaying an image according to an exemplary embodiment.

Referring to FIG. 1, the device 100 includes an organic light-emitting diode (OLED) panel unit 110, an image signal provider 120, and a voltage supply unit 200.

The OLED panel unit 110 receives an image signal and driving power to display an image. In detail, the OLED panel unit 110 may display the image in response to the image signal provided from the image signal provider 120, which will be described below, and the driving power supplied from the voltage supply unit 200. For this purpose, the OLED panel unit 110 may include a plurality of pixels having OLEDs.

The image signal provider 120 provides the image signal to the OLED panel unit 110. In detail, the image signal provider 120 provides image data and/or various types of image signals for displaying the image data to the OLED panel unit 110 in response to the image data. In particular, the image signal has a light-emission section which transmits information relating to a light-emission level and an addressing section which transmits address information applied to the light-emission section. More particularly, the image signal has one light-emission section and one addressing section for one frame period. As described above, the image signal has a pulse form and a transition section in which the addressing section transmits to the light-emission section, and a great voltage drop occurs.

The voltage supply unit 200 supplies the driving power to the OLED panel unit 110 and performs a feed-forward control with respect to the driving power based on the received image signal. In particular, the feed-forward control refers to a control method for estimating a change of a control caused by a disturbance to perform a control operation corresponding to the estimation in order to quickly respond to the control operation. In the present exemplary embodiment, the feed-forward control estimates a driving current required for the OLED panel unit 110 based on the image signal provided from the OLED panel unit 110 and controls the driving power supplied to the OLED panel unit 110 based on the estimated driving current. Detailed structure and operation of the voltage supply unit 200 will be described below with reference to FIGS. 3, 4, and 5.

A cable 210 supplies the driving power from the voltage supply unit 200 to the OLED panel unit 110. The cable 210 may also supply the voltage supply unit 200 with a voltage value of a node commonly connected to the OLED panel unit 110.

Figure 2:
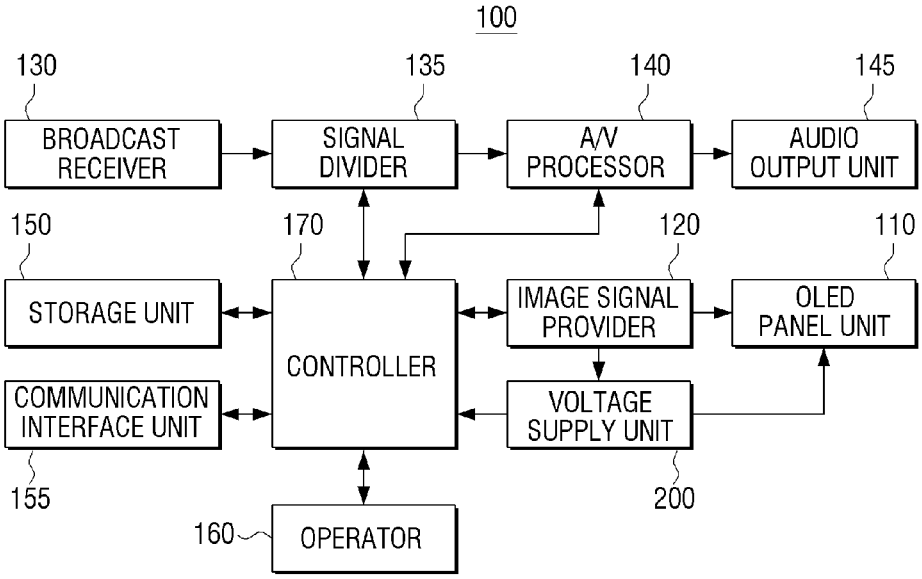
FIG. 2 is a block diagram which illustrates a detailed structure of the device of FIG. 1.

The simple structure of the device 100 has been described above, but the device 100 may include elements as shown in FIG. 2. A detailed structure of the device 100 will now be described with reference to FIG. 2.

FIG. 2 is a block diagram which illustrates a detailed structure of the device 100 of FIG. 1.

Referring to FIG. 2, the device 100 includes an OLED panel unit 110, an image signal provider 120, a broadcast receiver 130, a signal divider 135, an audio/video (A/V) processor 140, an audio output unit 145, a storage unit 150, a communication interface unit 155, an operator 160, a controller 170, and the voltage supply unit 200.

Operations of the OLED panel unit 110 and the voltage supply unit 200 are the same as those of the OLED panel unit 110 and the voltage supply unit 200 of FIG. 1, and thus repeated descriptions will be omitted herein. The voltage supply unit 200 supplies power only to the OLED panel unit 110 and the controller 170 in the present exemplary embodiment but may supply power to any or all elements of the device 100 which require power.

The broadcast receiver 130 receives a broadcast signal from a broadcasting station or a satellite by wired communication or wireless communication and demodulates the broadcast signal.

The signal divider 135 divides the demodulated broadcast signal into an image signal, an audio signal, and an additional information signal. The signal divider 135 also transmits the image signal and the audio signal to the A/V processor 140.

The A/V processor 140 performs signal processing, such as video decoding, video scaling, audio decoding, and/or other signal processing functions, with respect to the image signal and the audio signal received from the broadcast receiver 130 and/or the storage unit 150. The A/V processor 140 also outputs the image signal to the image signal provider 120, possibly via the controller 170, and the audio signal to the audio output unit 145.

If the received image and audio signals are stored in the storage unit 150, the A/V processor 140 may output the image and audio signals in compressed forms to the storage unit 150.

The audio output unit 145 converts the audio signal received from the A/V processor 140 to a sound, and outputs the sound through a speaker (not shown) or outputs the sound to a connected external device through an external output terminal (not shown).

The image signal provider 120 generates a graphic user interface (GUI) which is to be provided to a user. The image signal provider 120 also adds the GUI to an image outputted from the A/V processor 140. The image signal provider 120 provides the OLED panel unit 110 with the image signal corresponding to the image to which the GUI is added. Therefore, the OLED panel unit 110 displays various types of information provided from the device 100 and the image transmitted from the image signal provider 120.

The storage unit 150 may store image contents. In detail, the storage unit 150 may receive an image content having compressed image data and audio data from the A/V processor 140 and store the image content, and output the stored image content to the A/V processor 140 under control of the controller 170. The storage unit 150 may be realized as a hard disk, a nonvolatile memory, a volatile memory, or the like.

The operator 160 is realized as a touch screen, a touch pad, a key button, a key pad, or the like to provide for a user operation of the device 100. A control command may be inputted through the operator 160 of the device 100 in the present exemplary embodiment, but the operator 160 may receive a user operation via an external control device (e.g., a remote controller).

The communication interface unit 155 is formed to connect the device 100 to the external device and may be connected to the external device through a local area network (LAN) and the Internet or through a universal serial bus (USB) port.

The controller 170 controls an overall operation of the device 100. In detail, the controller 170 may control the image signal provider 120 and the OLED panel unit 110 to display the image based on the control command received through the operator 160.

As described above, the device 100 according to the present exemplary embodiment estimates a driving current required for an OLED panel unit and provides driving power corresponding to the estimated driving current to the OLED panel unit. Therefore, a great voltage drop of an OLED which may occur in a transition section due to a pulse form zone current OLED load characteristic may be attenuated. As a result, a light-emission delay of an OLED panel may be prevented, and thus an image quality may be improved.

As described above with reference to FIG. 2, the above-described function is applied only to an image display device which receives and displays a broadcast. However, a power supply device as described below may be applied to any electronic device having an OLED panel.

As described above, the voltage supply unit 200 is included in the device 100, but the function of the voltage supply unit 200 may be realized in an additional device. An additional power supply device performing the same function as the voltage supply unit 200 will now be described with reference to FIG. 3.

Figure 3:
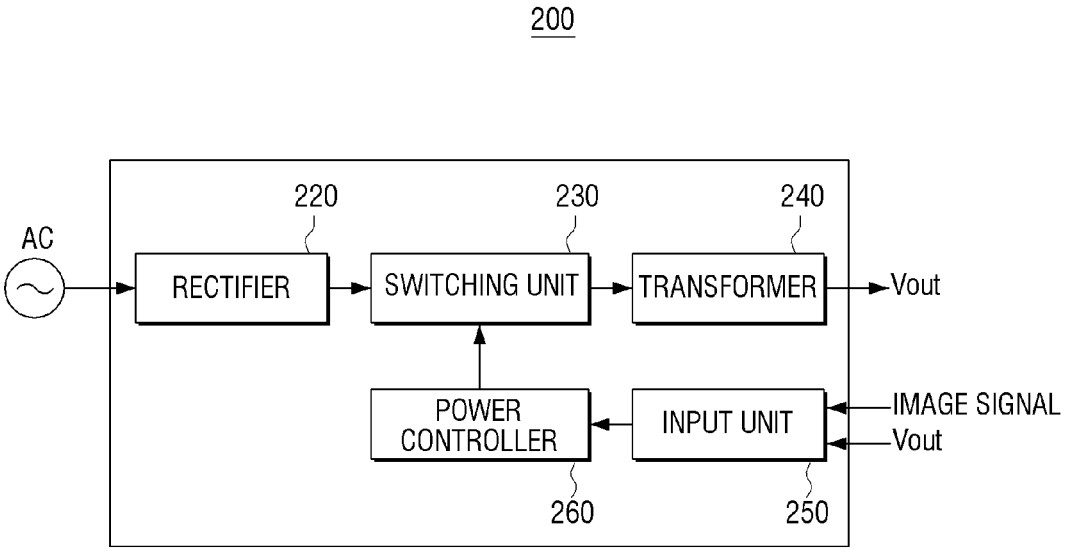
FIG. 3 is a block diagram which illustrates a detailed structure of a device for supplying power according to an exemplary embodiment.

FIG. 3 is a block diagram which illustrates a detailed structure of a device 200 for supplying power according to an exemplary embodiment.

Referring to FIG. 3, the device 200 includes a rectifier 220, a switching unit 230, a transformer 240, an input unit 250, and a power controller 260.

The rectifier 220 rectifies external alternating current (AC) power into direct current (DC) power. In detail, the rectifier 220 may rectify AC power provided from an external source to DC power having a preset level.

The switching unit 230 selectively supplies the rectified DC power to the transformer 240. In detail, the switching unit 230 may selectively provide the DC power output from the rectifier 220 to the transformer 240 under control of the power controller 260 which will be described below.

The transformer 240 transforms the rectified DC power into driving power and outputs the driving power. In detail, the transformer 240 may transform the DC power rectified by the rectifier 220 and received via the switching unit 230 into DC power having a level required for the OLED panel unit 110. In particular, the driving power outputted from the transformer 240 may be supplied to the OLED panel unit 110 via the cable 210.

The input unit 250 receives an image signal. In detail, the input unit 250 may receive the image signal provided to the OLED panel unit 110. The image signal received via the input unit 250 is provided to the power controller 260 to be used as information for a feed-forward control of the driving power. In the present exemplary embodiment, the image signal provided to the OLED panel unit 110 is received and used. However, only information (e.g., brightness information or an estimated driving current value) relating to the feed-forward control may be received and used.

The input unit 250 may also receive a voltage of the driving power outputted from the transformer 240. The input unit 250 may receive a voltage of a node that the cable 210 and the OLED panel unit 110 commonly contact. The voltage of the driving power received via the input unit 250 or the voltage of the node is provided to the power controller 260 to be used as information relating to a feedback control of the driving power.

The power controller 260 controls the switching unit 230 to perform the feed-forward control of the driving power outputted from the transformer 240 based on the image signal. In detail, the power controller 260 may estimate a driving current to be supplied to an OLED panel based on brightness information relating to the image signal received via the input unit 250, and may control the switching unit 230 based on the estimated driving current. In particular, the brightness information includes information relating to a light-emission level of an OLED panel unit and timing information to which the light-emission level is applied. Therefore, the power controller 260 may output the driving power corresponding to the brightness information at a timing corresponding to the brightness information by using a lookup table which stores a respective plurality of driving current values in conjunction with a corresponding plurality of light-emission levels of the OLED panel.

The power controller 260 may also perform the feedback control with respect to the driving voltage of the driving power. In detail, the power controller 260 may perform the feedback control with respect to the driving voltage of the driving power outputted from the transformer 240. The feedback control may be performed along with the feed-forward control. In particular, the feedback control refers to a control which compares a control variable with a target value and performs a correction operation in order to match the control variable with the target value. Therefore, the power controller 260 may use a light-emission level (i.e., a voltage value) corresponding to the brightness information as a target value and the driving voltage outputted from the transformer 240 as a control variable to perform the feedback control with respect to the driving voltage.

The power controller 260 may perform a feedback control with respect to the voltage of the node that is commonly contacted by the cable 210 and the OLED panel unit 110. In detail, because the device 200 supplies a zone current to the OLED panel, the voltage of the node may be lower than the driving voltage of the transformer 240. In particular, the driving voltage may be attenuated by the cable 210, and thus the power controller 260 may perform a feedback control based on the voltage of the node. The above-described feedback control may be simultaneously performed with the feed-forward control. Further, the feedback control may be simultaneously performed with the feedback control of the driving voltage outputted from the transformer 240.

As described above, the device 200 according to the present exemplary embodiment estimates a driving current required for an OLED panel and provides driving power corresponding to the estimated driving current to an OLED panel unit. Therefore, a great voltage drop of an OLED which may occur in a transition section due to a pulse form zone current OLED load characteristic may be attenuated.

Figure 4:
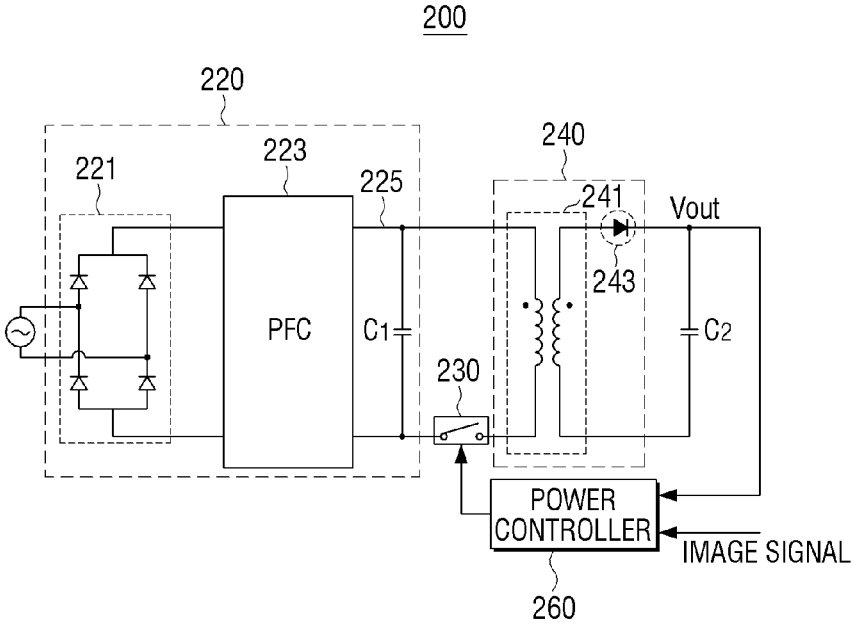
FIG. 4 is a circuit diagram of the device of FIG. 3.

FIG. 4 is a circuit diagram of the device 200 of FIG. 3.

Referring to FIG. 4, the device 200 includes the rectifier 220, the switching unit 230, the transformer 240, and the power controller 260.

The rectifier 220 rectifies external AC power to DC power. In detail, the rectifier 220 may include a rectifier circuit 221, a power factor correction (PFC) unit 223, and a capacitor 225.

The rectifier circuit 221 rectifies the external AC power. The rectifier circuit 221 may be realized as a bridge wave rectifier circuit as shown in FIG. 4.

The PFC (Power Factor Correction) unit 223 matches a phase of a voltage of the rectified AC power with a phase of a rectified current in order to ensure a same phase therebetween. In detail, the PFC unit 223 may match the phase of the voltage of the AC power rectified by the rectifier circuit 221 with a phase of a current by the rectifier circuit 221 in a same phase.

The capacitor 225 smoothes the AC power for which the voltage and the current are in a same phase. In detail, the capacitor 225 may smooth the AC power outputted from the PFC unit 223 to a DC power having a preset level.

The switching unit 230 includes a switching element. In detail, the switching element includes a first end connected to an output terminal of the rectifier 220 and a second end connected to an input terminal of the transformer 240. Therefore, the switching unit 230 may selective supply the DC power received from the capacitor 225 to the transformer 240 under control of the power controller 260. In the present exemplary embodiment, only one switch element is used. However, the switching unit 230 may use at least two switching elements to selectively supply the DC power received from the capacitor 225 to the transformer 240.

The transformer 240 transforms the rectified DC power to output driving power. In detail, the transformer 240 may include a transformer circuit 241 and a rectifier circuit 243.

The transformer circuit 241 transforms the DC power of the rectifier 220 received via the switching unit 230 into power having a level required for the OLED panel unit 110.

The rectifier circuit 243 rectifies the power outputted from the transformer circuit 241 to output DC power having a level required for the OLED panel unit 110. In the present exemplary embodiment, the power outputted from the transformer circuit 241 is rectified to the DC power by using a half-wave rectifier circuit. However, the power outputted from the transformer circuit 241 may be rectified to the DC power by using a full-wave rectifier circuit.

In particular, the driving power outputted from the transformer 240 may be supplied to the OLED panel unit 110 via the cable 210.

The power controller 260 may receive a driving voltage Vout of the driving power and an image signal and perform a feedback control and a feed-forward control with respect to the driving power to control a switching operation of the switching unit 230.

Figure 5:
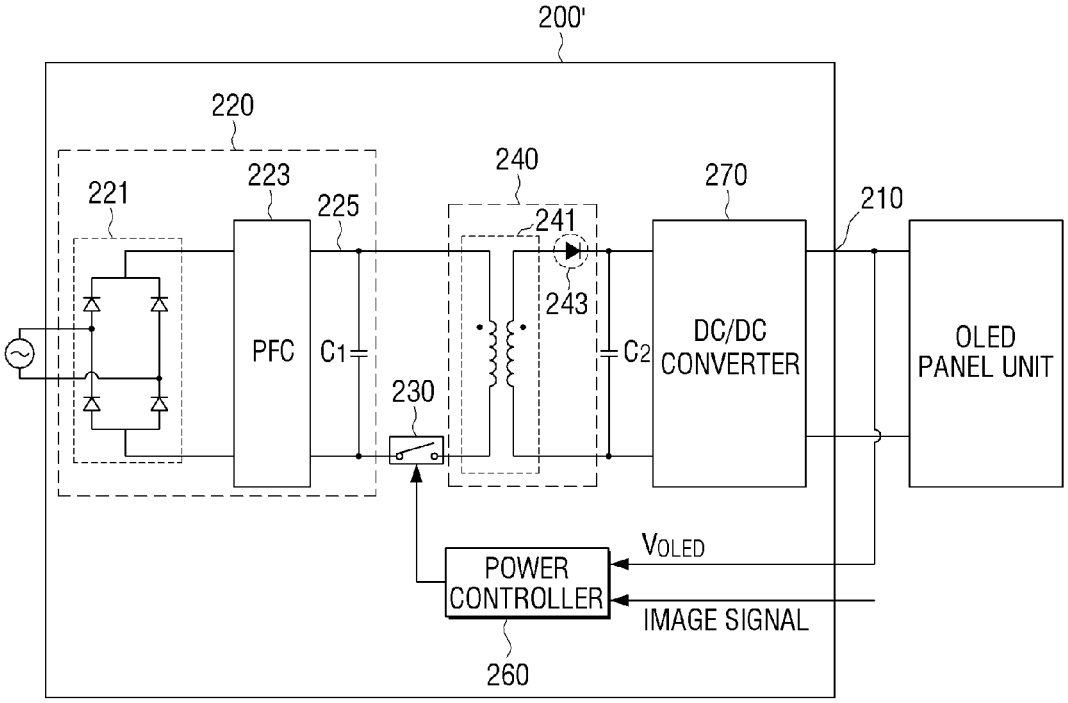
FIG. 5 is a circuit diagram of a device for supplying power according to another exemplary embodiment.

FIG. 5 is a circuit diagram of a device 200' for supplying power according to another exemplary embodiment.

Referring to FIG. 5, the device 200' includes a rectifier 220, a switching unit 230, a transformer 240, a power controller 260, and a DC/DC converter 270.

The rectifier 220 rectifies external AC power to DC power. In detail, the rectifier 220 includes a rectifier circuit 221, a PFC unit 223, and a capacitor 225.

The rectifier circuit 221 rectifies the external AC power. The rectifier circuit 221 may be realized as a bridge full-wave rectifier circuit as shown in FIG. 5.

PFC unit 223 matches a phase of a voltage of the rectified AC power with a phase of a rectified current in order to ensure a same phase therebetween. In detail, the PFC unit 223 may match the phase of the voltage of the AC power rectified by the rectifier circuit 221 with the phase of the rectified current by the rectifier circuit 221 in a same phase.

The capacitor 225 smoothes the AC power for which the voltage and the current are in a same phase. In detail, the capacitor 225 may smooth the AC power outputted from the PFC unit 223 to DC power having a preset level.

The switching unit 230 includes a switching element. In detail, the switching element includes a first end connected to an output terminal of the PFC unit 223 and a second end connected to an input terminal of the transformer 240. Therefore, the switching unit 230 may selectively supply the DC power of the capacitor 225 to the transformer 240 under control of the power controller 260. In the present exemplary embodiment, only one switching element is used. However, the switching element 230 may include at least two switching elements.

The transformer 240 transforms the rectified DC power. In detail, the transformer 240 may output the DC power selectively received via the switching unit 230 as DC power having a preset level by using an electric transformer.

The DC/DC converter 270 converts the transformed DC power. In detail, the DC/DC converter 270 may convert the DC power of the preset level transformed by the transformer 240 to DC power $V_{OLED}$ having a level required for driving an OLED panel.

The power controller 260 receives a driving voltage $V_{OLED}$ supplied to the OLED panel unit 110 and an image signal and performs a feedback control and a feed-forward control with respect to the driving power to control an switching operation of the switching unit 230.

Figures 6, 7:
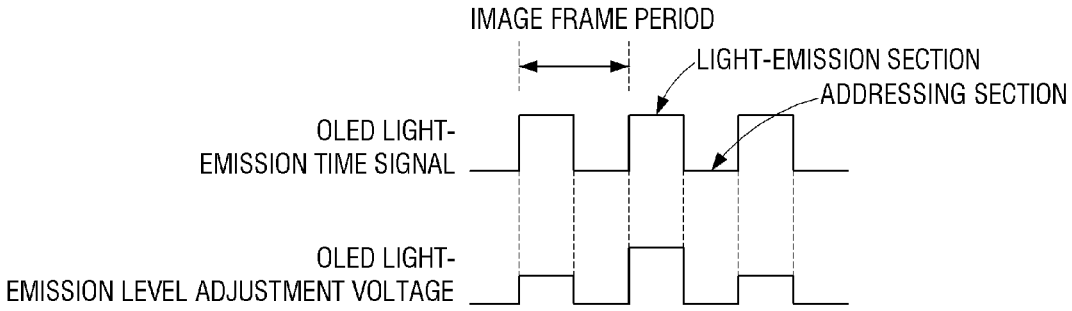
FIG. 6 is a view which illustrates an image signal according to an exemplary embodiment.
FIG. 7 is a view which illustrates a lookup table according to an exemplary embodiment.

FIG. 6 is a view which illustrates an image signal according to an exemplary embodiment.

Referring to FIG. 6, the image signal has a preset frame period which has a light-emission section in which an OLED panel emits light and an addressing section in which light is not emitted. The light-emission section and the addressing section have different OLED light-emission level adjusting voltage values.

Therefore, in the present exemplary embodiment, a feed-forward control is performed by using information relating to the OLED light-emission level adjusting voltage value in the light-emission section and information (i.e., timing information) relating to the light-emission section to which the OLED light-emission level adjusting voltage value is applied.

FIG. 7 is a view which illustrates a lookup table 700 according to an exemplary embodiment.

Referring to FIG. 7, the lookup table 700 stores information relating to a respective plurality of driving current values in conjunction with a corresponding plurality of light-emission levels. In particular, the light-emission levels may be average light-emission levels for all pixels of an OLED panel.

Figure 8:
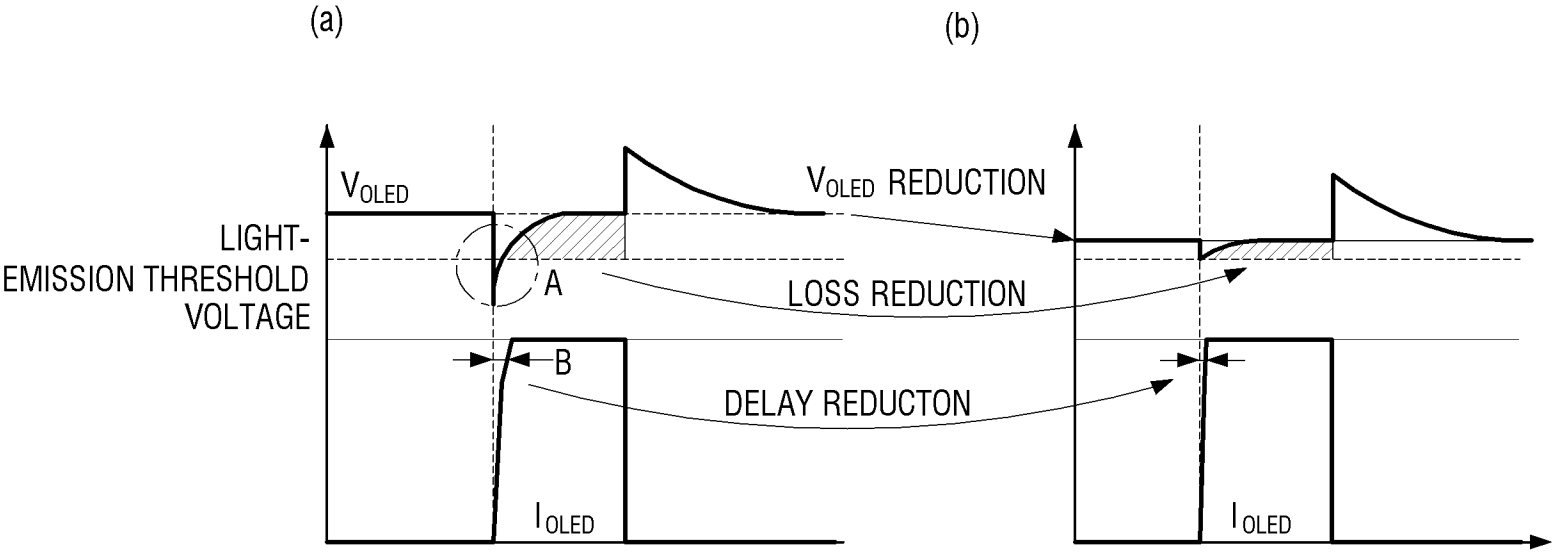
FIG. 8 is a pair of graphs which illustrate waveforms of driving power of a voltage supply unit according to an exemplary embodiment.

FIG. 8 is a pair of graphs which illustrate waveforms of driving power of a voltage supply unit according to an exemplary embodiment. In detail, graph (a) of FIG. 8 is a graph which illustrates waveforms of driving power if only a feedback control is performed with respect to the driving power, and graph (b) of FIG. 8 is a graph which illustrates waveforms of driving power if a feed-forward control is performed with respect to the driving power.

Referring to graph (a) of FIG. 8, because an OLED panel is driven by a pulse form driving voltage, a great drop occurs in a driving voltage in section A in which a pulse transits. Therefore, a supply of a driving current supplied to the OLED panel is delayed, as marked with reference character B.

However, referring to graph (b) of FIG. 8, a value of a driving current required for a next pulse is estimated. Therefore, although a pulse transits, a great voltage drop does not occur. As a result, a supply of the driving current to the OLED panel is not delayed. Further, a driving voltage $V_{OLED}$ is precisely supplied to the OLED panel. Therefore, a lower driving voltage than in a feedback control is supplied, and power consumption is reduced.

Figure 9:
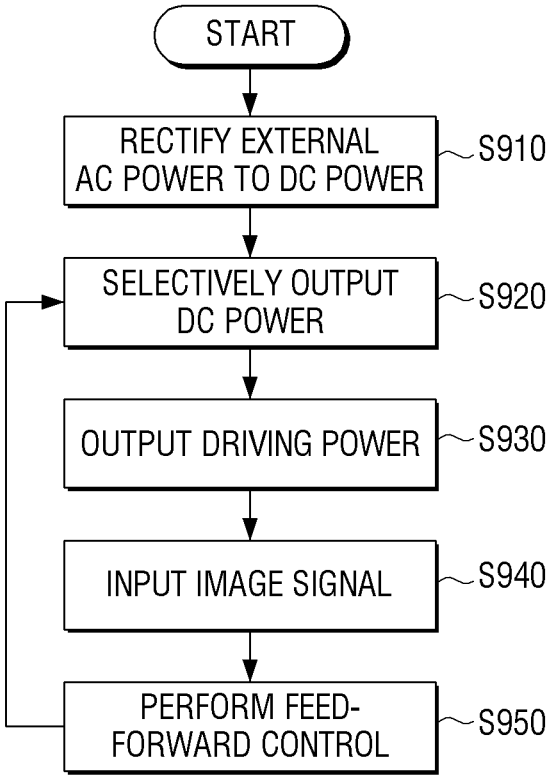
FIG. 9 is a flowchart which illustrates a method for supplying power according to an exemplary embodiment.

FIG. 9 is a flowchart which illustrates a method for supplying power according to an exemplary embodiment.

Referring to FIG. 9, in operation S910, external AC power is rectified to DC power. In detail, AC power supplied from an external source may be rectified to DC power having a preset level.

In operation S920, the rectified DC power is selectively outputted. In detail, the rectified DC power may be selectively outputted according to a feed-forward control which will be described below.

In operation S930, the selectively outputted rectified DC power is transformed. In detail, the selectively output DC power may be transformed to be outputted as driving power to an OLED panel.

In operation S940, an image signal which is to be supplied to the OLED panel is received. In detail, the image signal supplied to the OLED panel may be received.

In operation S950, a feed-forward control is performed with respect to the output driving power based on the received image signal. In detail, a driving current supplied to the OLED panel may be estimated based on brightness information relating to the image signal, and the feed-forward control may be performed based on the estimated driving current. In particular, the brightness information includes information relating to a light-emission level of the OLED panel and timing information to which the light-emission level is applied. Therefore, the driving power corresponding to the brightness information may be output at a timing corresponding to the brightness information by using a lookup table which stores a respective plurality of driving current values in conjunction with a corresponding plurality of light-emission levels of the OLED panel. A feedback control may be performed with respect to a driving voltage of the transformed and output driving power, and the feed-forward control may be performed based on the image signal. Further, a feedback control may be performed with respect to a voltage of a node that is commonly contacted by a cable supplying the driving power to the OLED panel and the OLED panel, and the feed-forward control may be performed based on the image signal.

Accordingly, in the method for supplying power according to the present exemplary embodiment, the driving current required for the OLED panel is estimated, and the driving power corresponding to the estimated driving current is supplied to the OLED panel. Therefore, an OLED great voltage drop which may occur in a transition section due to a pulse form zone current OLED load characteristic may be attenuated. The method of FIG. 9 may be performed by an image display device having the structure of FIG. 1, a power supply device having the structure of FIG. 9, or image display devices or power supply devices having the other structures.

Figure 10:
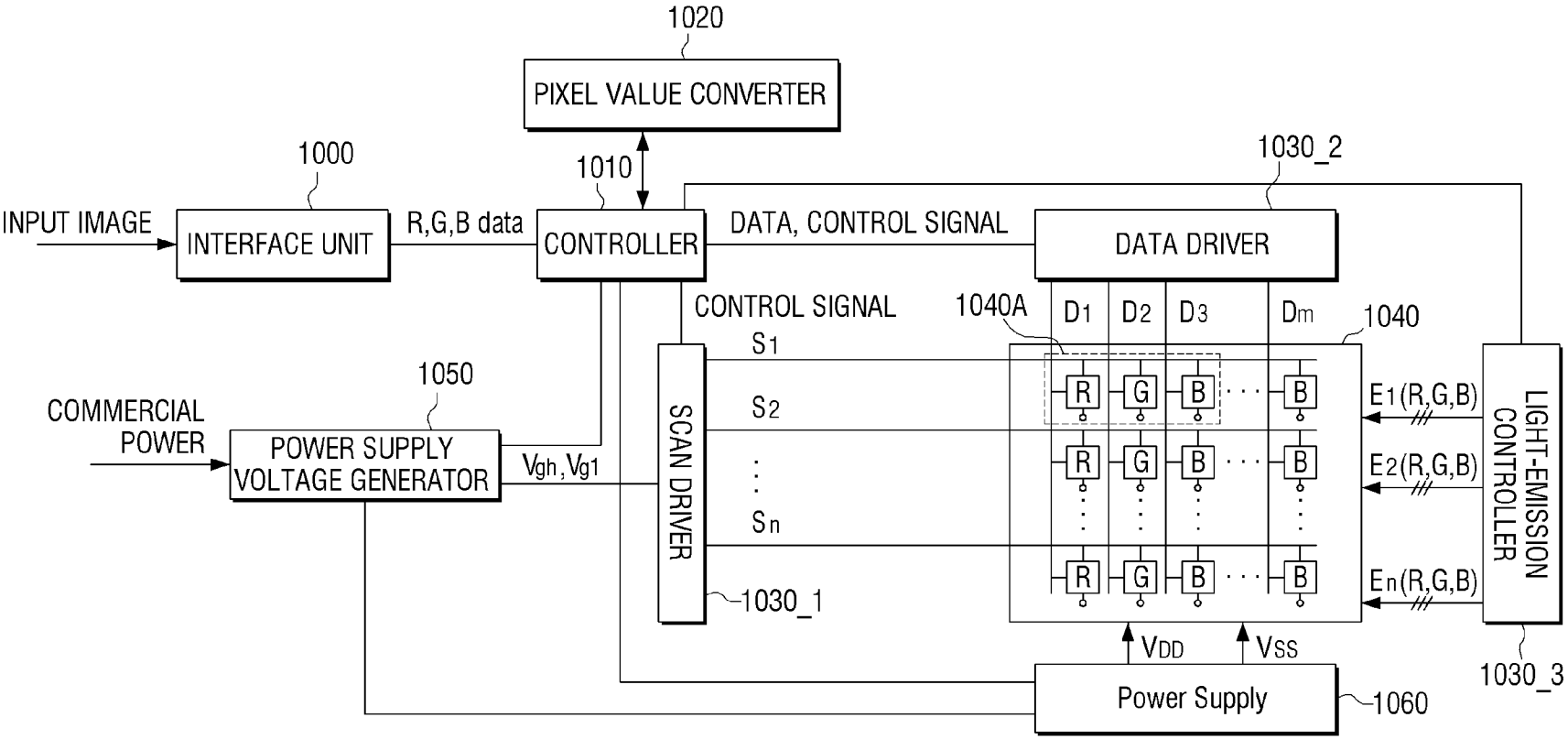
FIG. 10 is a block diagram which illustrates a structure of a device for displaying an image according to another exemplary embodiment.
Figure 11:
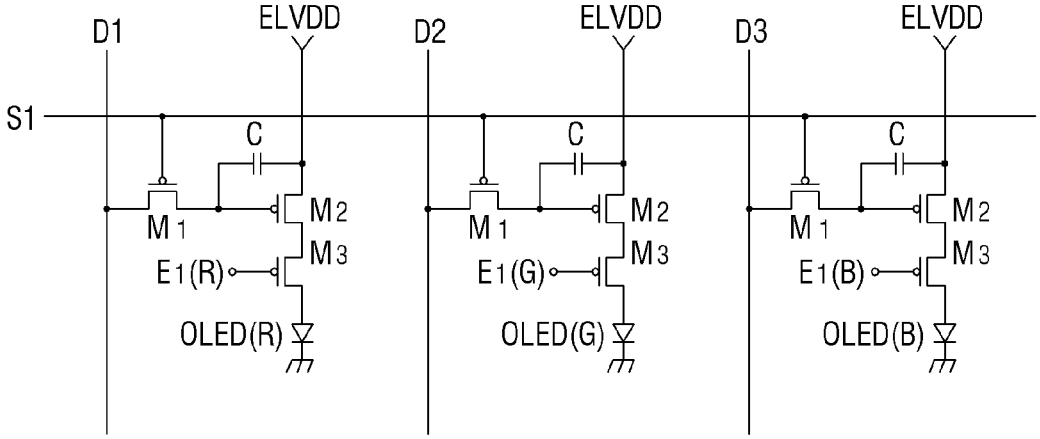
FIG. 11 is a view which illustrates a detailed structure of a pixel unit of FIG. 10.
Figure 12:
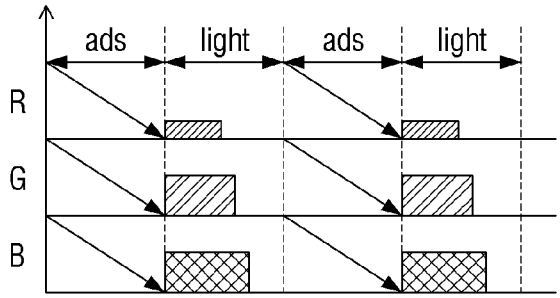
FIG. 12 is a view which illustrates a pulse width modulation (PWM) control of a switching element of FIG. 11.

FIG. 10 is a block diagram which illustrates a structure of a device for displaying an image according to another exemplary embodiment. FIG. 11 is a view which illustrates a detailed structure of a pixel unit of FIG. 10. FIG. 12 is a graph which illustrates a pulse width modulation (PWM) control of a switching element of FIG. 11.

Referring to FIG. 10, the device includes an interface unit 1000, a controller 1010, a pixel value converter 1020, a scan driver 1030_1, a data driver 1030_2, a light-emission controller 1030_3, a panel unit 1040, a power supply voltage generator 1050, and a part or a whole of a voltage supply unit 1060.

The interface unit 1000 is an image board such as a graphic card, and converts image data received from an external source such that the image data is appropriate for a resolution of the device and outputs the converted image data. In particular, the image data may be 8-bit R, G, and B video data, and the interface unit 1000 generates control signals, such as a clock signal DCLK, and vertical and horizontal sync signals Vsync and Hsync, which are appropriate for the resolution of the device. The interface unit 1000 also provides the vertical/horizontal sync signal and the image data to the controller 1010.

The controller 1010 receives the vertical/horizontal sync signal from the interface unit 1000, generates a gate control signal for controlling the scan driver 1030_1 and a data control signal for controlling the data driver 1030_2, re-arranges the 8-bit R, G, and B data received via the interface unit 1000 into 6-bit R, G, and B data, and re-supplies the 6-bit R, G, and B data to the data driver 1030_2. Therefore, the controller 1010 may include a control signal generator which generates a control signal and a data re-arranger which re-arranges data. The R, G, and B data rearranged by the controller 1010 may be set to correspond to gradation information of the R, G, and B data through a logic voltage Vlog provided from the power supply voltage generator 1050.

The controller 1010 also generates a gate shift clock (GSC), a gate output enable (GOE), a gate start pulse (GSP), and other relevant signals in relation to the gate control signal. In particular, the GSC is a signal which determines a time when a gate of a thin film transistor (TFT) connected to light-emitting devices, such as R, G, and B organic light-emitting diodes (OLEDs), is turned on/off. The GOE is a signal which controls an output of the scan driver 1030_1, and the GSP is a signal which shows a first driving line a screen for one vertical sync signal.

The controller 1010 generates a source sampling clock (SSC), a source output enable (SOE), a source start pulse (SSP), and other relevant signals in relation to the data control signal. In particular, the SSC is used as a sampling clock for latching data in the data driver 1030_2 and determines a driving frequency of a data drive integrated circuit (IC). The SOE transmits the data latched by the SSC to the panel unit 1040. The SSP is a signal which shows a latch or sampling start of data for a horizontal sync period.

The controller 1010 operates in conjunction with the pixel value converter 1020 and the light-emission controller 1030_3. For example, the controller 1010 operates together with the pixel value converter 1010 to convert a pixel gradation value generated through a rearrangement of R, G, and B data and provides the converted pixel gradation value to the data driver 1030_2. Further, the controller 1010 adjusts a current value provided to R, G, and B light-emitting devices by using the converted pixel gradation value to compensate for the current value. Therefore, the controller 1010 may further include a conversion value calculator (not shown) to check a range of a conversion value. In particular, the range of the conversion value indicates a difference between an input pixel gradation value and a converted pixel gradation value.

The pixel value converter 1020 may include a memory unit which stores conversion values in a lookup table (LUT) form according to an exemplary embodiment. The conversion values having the LUT form may be set by a system designer in the manufacture of the device, or may be stored through an additional setting process. In particular, the system designer knows that the conversion values are both end voltages of a switching element connected to the R, G, and B light-emitting devices of the panel unit 1040, i.e., headroom voltages. Therefore, the system designer may store the conversion values in the LUT form in consideration of this. If the controller 1010 provides a gradation value of a pixel after the conversion values are stored as described above, the pixel value converter 1020 provides a matching converted pixel gradation value. If the pixel value converter 1020 is set to provide "000010" for input 6-bit data "000011," the controller 1010 may output "000010" matching with "000011" when the pixel value converter 1020 provides "000011." In the present exemplary embodiment, the headroom voltages are to be lowered, and thus a converted pixel gradation value may be smaller than a gradation value provided from the controller 1010.

The scan driver 1030_1 receives a gate on/off voltage Vgh/Vgl from the power supply voltage generator 1050 and applies the gate on/off voltage Vgh/Vgl to the panel unit 1040 under control of the controller 1010. The gate on voltage Vgh is sequentially supplied from a first gate line S1 to an $N^{th}$ gate line Sn in order to realize a unit frame image on the panel unit 1040.

The data driver 1030_2 converts serial R, G, and B video data provided from the controller 1010 to parallel R, G, and B video data, and converts digital data to analog data in order to provide video data corresponding to one horizontal line to the panel unit 1040 simultaneously and sequentially every horizontal line. Video data provided from the controller 1010 may be provided to a digital-to-analog converter (DAC), and digital information relating to the video data provided to the DAC may be converted to an analog voltage for representing gradations of colors and provided to the panel unit 1040.

The light-emission controller 1030_3 generates a control signal having a varying duty ratio, and provides the control signal to the panel unit 1040 under control of the controller 1010. In particular, the duty ratio of the control signal is set to vary based on colors of R, G, and B light-emitting devices. For example, the light-emission controller 1030_3 may include a pulse width modulation (PWM) signal generator which may generate the control signal having a duty ratio which varies based on colors of light-emitting devices under control of the controller 1010. In this case, the light-emission controller 1030_3 may further include switching elements. The switching elements may operate under control of the controller 1010 in order to control an output time of a PWM signal applied to the panel unit 1040.

For example, when a turn-on time of the B light-emitting device is 1000, the light-emission controller 1030_3 may generate the control signal such that a turn-on time of the G light-emitting device is shorter than a turn-on time of the B light-emitting device, and such that a turn-on time of the R light-emitting device is shorter than the turn-on time of the B light-emitting device. In particular, a turn-on time, i.e., a driving time, may be set to be relatively long in proportion to a correspondingly high driving voltage of a light-emitting device. In more detail, if the panel unit 1040 includes R, G, and B color light-emitting devices, the light-emission controller 1030_3 may set a turn-on time so that the turn-on time satisfies Equation 1 below:

$$ix_org \times Dx_org = ix_calc \times Dx_calc$$

wherein ix_org denotes a current value corresponding to a received pixel value, Dx_org denotes a turn-on time corresponding to the received pixel value, ix_calc denotes a current value calculated by a controller, and Dx_calc denotes a turn-on time calculated by the controller. However, x can be equal to R, G, and/or B.

The panel 1040 includes a plurality of gate lines S1 through Sn and a plurality of data lines D1 through Dm which define pixel areas. Each of the gate lines S1 through Sn crosses each of the data lines D1 through Dm, and R, G, and B light-emitting devices, such as OLEDs, may be formed in respective pixel areas in which the gate lines S1 through Sn cross the data lines D1 through Dm. Switching elements, i.e., TFTs, are formed in areas of pixel areas, and in more detail, at corners of the pixel areas. When the TFTs are turned on, a gradation voltage is supplied from the data driver 1030_2 to each of the R, G, and B light-emitting devices. In particular, the R, G, and B light-emitting devices provide light in response to a provided current amount based on the gradation voltage. More particularly, if a large amount of current is supplied, each of the R, G, and B light-emitting devices provides a large amount of light based on the correspondingly large amount of current.

R, G, and B pixel units will now be described in more detail. As shown in FIG. 11, the panel unit 1040 may further include switching elements $M_2$ (hereinafter referred to as first switching elements) and switching elements $M_3$ (hereinafter referred to as second switching elements). The first switching elements $M_2$ output respective currents based on conversion values provided to the data lines D1 through Dm. The second switching elements $M_3$ adjust respective amounts of currents provided from the first switching elements $M_2$ to the R, G, and B light-emitting devices based on a control signal provided from the light-emission controller 1030_3. Further, the R, G, and B light-emitting devices of the panel unit 1040 receive a control signal having a varying duty ratio from the light-emission controller 1030_3 via one line, but may receive control signals via different lines according to the same color. However, in the present exemplary embodiment, if a control signal whose duty ratio is adjusted to vary is applied to light-emitting devices having the same colors, forming its line is not particularly limited.

The power supply voltage generator 1050 receives a commercial voltage, i.e., an AC voltage of 1010V or 220V, from an external source in order to generate and output DC voltages having various levels. For example, the power supply voltage generator 1050 may generate a DC voltage of 12V and provide the DC voltage of 12V to the controller 1010 in order to represent gradations. The power supply voltage generator 1050 may generate a DC voltage of 15V as a gate on voltage Vgh and provide the DC voltage of 15V to the scan driver 1030_1. The power supply voltage generator 1050 may generate a DC voltage of 24V and provide the DC voltage of 24V to the voltage supply unit 1060. In particular, the power supply voltage generator 1050 may generate and provide voltages having various levels.

The voltage supply unit 1060 receives a voltage from the power supply voltage generator 1050 to generate a power supply voltage VDD required for the panel unit 1040 and provides the power supply voltage VDD to the panel unit 1040 or provides a ground voltage VSS to the panel unit 1040. Further, the voltage supply unit 1060 receives a DC voltage of 24V from the power supply voltage generator 1050 to generate a plurality of power supply voltages VDD, selects a particular power supply voltage VDD under control of the controller 1010, and supplies the particular power supply voltage VDD to the panel unit 1040. For this purpose, the voltage supply unit 1060 may further include switching elements which supply a selected particular voltage under control of the controller 1010.

Operations of the R, G, and B light-emitting devices constituting pixels will now be described in more detail with reference to FIGS. 10, 11, and 12. FIG. 11 is a circuit diagram which illustrates a detailed structure of a pixel unit of FIG. 10.

Referring to FIGS. 10 and 11, the controller 1010 controls the scan driver 1030_1 to apply a scan signal, i.e., the gate on voltage Vgh, to the first gate line S1. Therefore, switching elements $M_1$ of FIG. 11 are simultaneously turned on. The controller 1010 also controls the data driver 1030_2 to provide a converted pixel value via the data lines D1, D2, and D3.

The provided converted pixel value charges capacitors C through the switching elements $M_1$, and the first switching elements $M_2$ are turned on by the charged value. A current corresponding to a level of a turn-on voltage is supplied from the second switching elements $M_3$ to each of the R, G, and B light-emitting devices.

In particular, each of the second switching elements $M_3$ operates based on the control signal, which has a duty ratio which varies based on colors and is provided from the light-emission controller 1030_3, to adjust amounts of currents respectively supplied from the switching elements $M_1$ to the respective R, G, and B light-emitting devices. According to an exemplary embodiment, as shown in FIG. 12, among turn-on times of the R, G, and B light-emitting devices, the turn-on time of the B light-emitting device is the longest, and the turn-on time of the R light-emitting device is the shortest. This is generalized as follows. A turn-on time of a light-emitting device driven at a relatively high driving voltage may be set to be correspondingly longer based on the relative value of the driving voltage as compared with the driving voltages of the other light-emitting devices.

Accordingly, the device according to the present exemplary embodiment does not lower a headroom voltage applied between both ends of each of the switching elements $M_2$ and connected to an end of each of the R, G, and B light-emitting devices shown in FIG. 11, i.e., between a source and a drain. However, the device adjusts duty ratios $M_3$ of the switching elements, i.e., turn-on times, to adjust and compensate for the respective amounts of currents supplied to each of the R, G, and B light-emitting devices. Therefore, although converted pixel values are applied, original gradations and brightness are maintained.

In the device according to the present exemplary embodiment, the scan driver 1030_1 or the data driver 1030_2 may be mounted on the panel unit 1040, and the light-emission controller 1030_3 may be included in the controller 1010, or may be mounted on the panel unit 1040. Further, the voltage supply unit 1060 may be integrated with the power supply voltage generator 1050, and the controller 1010 may operate as a pixel value converter 1020 when rearranging data. Therefore, in the present exemplary embodiment, combinations and separations of elements of the device are not particularly limited.

Figure 13:
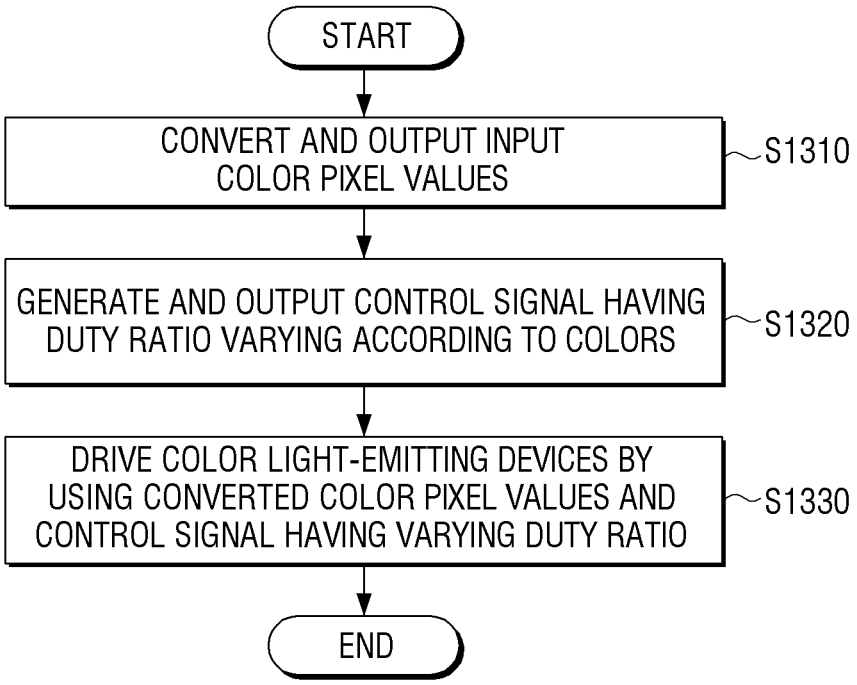
FIG. 13 is a flowchart which illustrates a method for displaying an image according to another exemplary embodiment.

FIG. 13 is a flowchart which illustrates a method for displaying an image according to another exemplary embodiment.

For the descriptive convenience, referring to FIG. 13 along with FIG. 10, in operation S1310, an image display device, more precisely, the controller 1010, converts and outputs received R, G, and B data, i.e., pixel values. If conversion information relating to a difference between a received pixel value and a corrected pixel value is generated in this process, the corresponding conversion information may be outputted together with the respective pixel value. According to an exemplary embodiment, the image display device may pre-store conversion pixel values matching with R, G, and B data received by the pixel value converter 1020 of FIG. 10 from an external source in a LUT form, and output a corresponding conversion pixel value when the controller 1010 requests a conversion pixel value.

In operation S1320, the light-emission controller 1030_3 of the image display device generates and outputs a control signal having a duty ratio which varies based on color pixels under control of the controller 1010. For example, if the B light-emitting device of the R, G, and B light-emitting devices is driven at the highest voltage, the B light-emitting device may provide a pixel value which is lower than a received original pixel value as a conversion value. In particular, a ratio of a turn-on time of a duty ratio of the B light-emitting device may be set to be relatively higher than ratios of turn-on times of duty ratios of the R and B light-emitting devices which are driven at lower voltages. More particularly, if the turn-on time of the B light-emitting device is 1000, the ratio of the G light-emitting device may be set to be approximately equal to 80, and the ratio of the R light-emitting device may be set to be approximately equal to 60. The above-described turn-on times may be set to be variously changed based on conversion information and thus are not limited thereto in the present exemplary embodiment.

In operation S1330, the image display device drives each of the color light-emitting devices by using the conversion pixel value and the control signal having the varying duty ratio. In particular, the image display device adjusts a respective amount of generated current by using the control signal having the varying duty ratio based on the corresponding conversion pixel value and drives each of the R, G, and B light-emitting devices by using the adjusted current. For this purpose, the image display device turns on first switching elements, to which a power supply voltage is applied, by using a conversion pixel value to output a current corresponding to the conversion pixel value to the first switching elements. The image display device also adjusts turn-on times of second switching elements based on the R, G, and B pixels by using the control signal having the duty ratio which varies based on colors in order to adjust respective amounts of currents supplied to light-emitting devices constituting R, G, and B pixels.

Therefore, heat emission of the first switching elements is reduced more than when the first switching elements are driven by using an original pixel value. Further, the second switching elements are PWM-controlled by a difference in the reduced pixel value, and thus gradations and brightness of the R, G, and B pixels are equally maintained, similarly as when the second switching elements are driven by using an original pixel value.

The method according to the present exemplary embodiment has been performed by the image display device having the structure of FIG. 10, but may be performed by image display devices having other types of structures. Therefore, the method of the present exemplary embodiment is not restricted to be performed only by the image display device.

Figure 14:
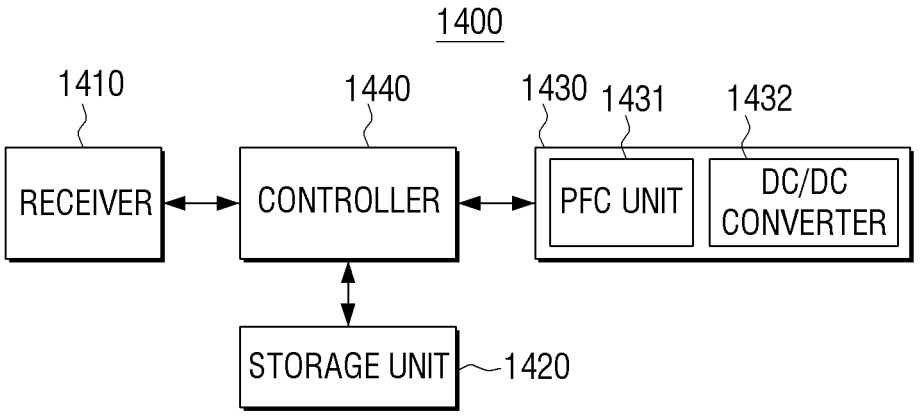
FIG. 14 is a block diagram which illustrates a device for supplying power according to another exemplary embodiment.

FIG. 14 is a block diagram which illustrates a device 1400 for supplying power according to another exemplary embodiment.

Referring to FIG. 14, the device 1400 includes a receiver 1410, a storage unit 1420, a voltage supply unit 1430, and a controller 1440. In particular, the voltage supply unit 1430 includes a PFC unit 1431 and a DC/DC converter 1432.

The device 1400 may be used in an organic light-emitting display device including a panel unit which includes a plurality of pixels having OLEDs. The device 1400 may be used in the organic light-emitting display device to supply power ELVDD. The device 1400 may also supply power ELVSS. In particular, the device 1400 may supply the power ELVDD and the power ELVSS, and may also supply driving power to all elements (e.g., a data driver (not shown) and a scan driver (not shown) which constitute the organic light-emitting display device and require power.

The receiver 1410 receives an image signal. In detail, the receiver 1410 may receive a plurality of pieces of image frame data which constitute image data. In particular, each of the pieces of the image frame data has R, G, and B components. If the image frame data is received, the receiver 1410 transmits the received image frame data to the controller 1440.

The storage unit 1420 stores various types of programs and data required for driving the device 1400.

In detail, the storage unit 1420 may store a maximum current value which is corrected based on temperature information, a voltage level corresponding to the corrected maximum current value, and a buildup time under control of the controller 1440 which will be described below.

In particular, the above-mentioned values may be stored in a LUT form.

Further, the storage unit 1420 may be realized as an embedded storage device, such as a random access memory (RAM), a flash memory, a read only memory (ROM), an erasable programmable ROM (EPROM), an electronically erasable and programmable ROM (EEPROM), a register, a hard disk, a removable disk, a memory card, or the like, or a removable storage device such as a universal serial bus (USB) memory or the like.

The voltage supply unit 1430 supplies a DC voltage to a plurality of pixels constituting a panel unit (not shown).

In detail, under control of the controller 1440 which will be described below, the voltage supply unit 1430 may supply a voltage ELVDD to the panel unit. In particular, the voltage ELVDD is converted to a DC voltage having a voltage level corresponding to the calculated maximum current value.

Under control of the controller 1440, the voltage supply unit 1430 may also start a conversion job before a buildup time based on an output timing of a back one of two image frames by using the calculated buildup time.

Under control of the controller 1440, the voltage supply unit 1430 may supply a voltage ELVDD to the panel unit. In particular, the voltage ELVDD is converted to a DC voltage having a voltage level corresponding to the maximum current value which is corrected based on the temperature information of the panel unit.

The voltage supply unit 1430 may also supply a voltage ELVSS.

In particular, the voltage supply unit 1430 may include the PFC unit 1431 and the DC/DC converter 1432 which supplies DC power.

In detail, the PFC unit 1431 corrects a power factor of an input voltage and outputs the power factor to the DC/DC converter 1432. In particular, the PFC unit 1431 is positioned adjacent to a rectifier (not shown). If an AC voltage is rectified by the rectifier to be generated as a DC voltage, the PFC unit 1431 may correct a power factor of the DC voltage and output the DC voltage having the corrected power to the DC/DC converter 1432. In general, an output of the PFC unit 1431 in the organic light-emitting display device may be approximately equal to 400V.

In particular, the PFC unit 1431 is added as a power-saving circuit to adjust power supplied to components including a transformer, a stabilizer, and/or other types of components from which an instant power leak is concerned, in order to improve power efficiency of the voltage supply unit 1430. More particularly, the PFC unit 1431 reduces power consumption and prevents a temperature from rising due to a change of a current to heat in order to improve power efficiency.

In particular, the PFC unit 1431 may have a boost topology.

The DC/DC converter 1432 supplies a DC voltage. In particular, the DC/DC converter 1432 may receive the voltage having the corrected power factor from the PFC unit 1431 and convert the voltage to a DC voltage required for the organic light-emitting display device under control of the controller 1440.

More particularly, the DC/DC converter 1432 may be constituted by using a conventional DC/DC converter circuit.

The controller 1440 controls an overall operation of the device 1400. In detail, the controller 1440 may control the receiver 1410, the storage unit 1420, and the voltage supply unit 1430.

The controller 1440 controls the voltage supply unit 1430 to respectively check R, G, and B values of the image frame data received via the receiver 1410 in order to calculate a maximum current value, convert a DC voltage to a DC voltage having a voltage level corresponding to the calculated maximum current value, and supply the converted DC voltage to the power supply unit 1430 In particular, the controller 1440 may check R, G, B values of the image frame data to detect maximum gradation values of R, G, and B. The controller 1440 may also calculate a value of a current which flows in each of the R, G, and B OLEDs by using the maximum gradation values of R, G, and B. In this case, the controller 1440 may detect a maximum current value from the calculated current values and determine a voltage ELVDD to be supplied, by using the detected maximum current value. Therefore, the controller 1440 may control the DC/DC converter 1432 to supply the determined voltage ELVDD.

In particular, the maximum current value is used to represent all gradation levels of R, G, and B included in the received image frame data.

More particularly, in the conventional art, a fixed voltage ELVDD of 12V is supplied as a voltage ELVDD which is supplied to a plurality of pixels of an organic light-emitting display device. However, if the fixed voltage of 12V is supplied in a situation that R, G, and B values are low gradations (i.e., if a current supplied to OLEDs is a relatively low current), a headroom voltage applied to a driving transistor T2 does not reflect gradation levels of R, G, and B. Therefore, a large amount of power is consumed due to heat generated from the driving transistor T2.

However, the device 1400 according to the present exemplary embodiment may respectively check R, G, and B values of frame data to calculate a maximum current value, convert a DC voltage to a DC voltage having a voltage level corresponding to the maximum current value, and supply the converted DC voltage, in order to improve power efficiency.

Further, the controller 1440 may respectively calculate maximum current values corresponding to R, G, and B of two consecutive image frames and calculate a difference between voltage levels corresponding to the maximum current values to estimate a buildup time required for a conversion job between the voltage levels. Therefore, the controller 1440 may control the DC/DC converter 1432 to start the conversion job before the buildup time based on an output timing of the back one of the two image frames.

As described above, a buildup time required for a conversion job between voltage levels required for consecutive frames may be estimated to further improve power efficiency.

The controller 1440 may also control the voltage supply unit 1430 to correct the maximum current value based on the temperature information relating to the panel unit, convert the DC voltage to the DC voltage having a voltage level corresponding to the corrected maximum current value, and apply the converted DC voltage. In particular, the organic light-emitting display device generates heat according to its use. More particularly, OLEDs show characteristics sensitive to temperature. Therefore, if the OLEDS supply the voltage ELVDD without reflecting the temperature information, an accurate gradation level matching with received image frame data may not be represented. Therefore, the device 1400 according to the present exemplary embodiment may consider an effect of temperature changes of the OLEDs to improve power efficiency and represent an accurate gradation.

In an exemplary embodiment, the controller 1440 may convert an output DC voltage of the DC/DC converter 1432 by using a digital control method such as a PWM or a pulse frequency modulation (PFM).

Further, the controller 1440 may control the storage unit 1420 to store the maximum current value corrected based on the temperature information, the voltage level corresponding to the corrected maximum current value, and the buildup time. Therefore, if R, G, and B values of subsequent image frame data are the same as R, G, and B values of current image frame in the same temperature condition, the controller 1440 may control an operation of the DC/DC converter 1432 by using information stored in the storage unit 1420. In addition, if a difference between voltage levels corresponding to maximum current values of R, G, and B of two consecutive image frames is the same as a difference between voltage levels for the buildup time stored in the storage unit 1420, the controller 1440 may control the DC/DC converter 1432 to start a conversion job before the buildup time based on an output timing of the back one of the two consecutive image frames by using the buildup time stored in the storage unit 1420.

In particular, the controller 1440 may control the voltage supply unit 1430 to adaptively vary a driving voltage based on color information (i.e., R, G, and B distribution charts, a color temperature distribution chart, and/or other relevant color information) relating to frame data and supply the driving voltage to the panel unit in order to process a plurality of frames and display the plurality of frames on the panel unit.

Figure 15:
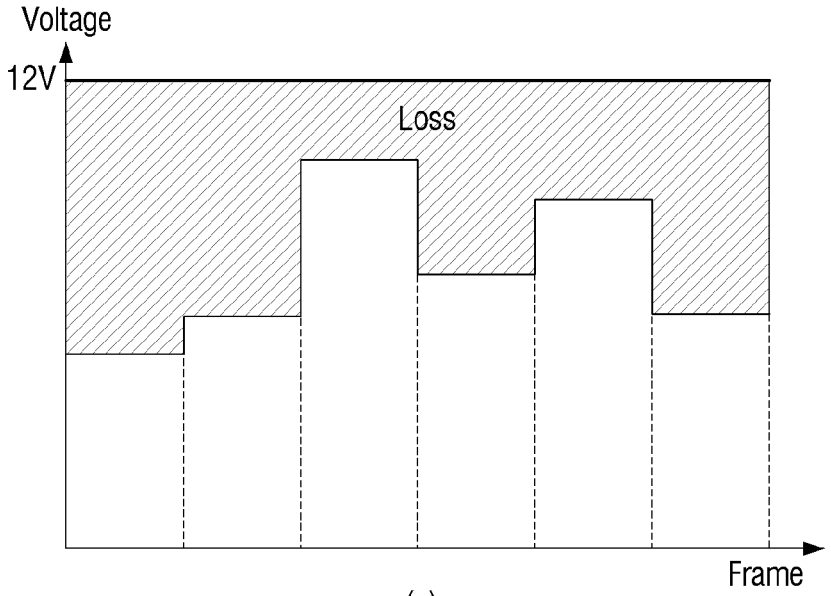
FIG. 15 is a pair of graphs which illustrate a method for supplying power according to another exemplary embodiment.
Figure 15:
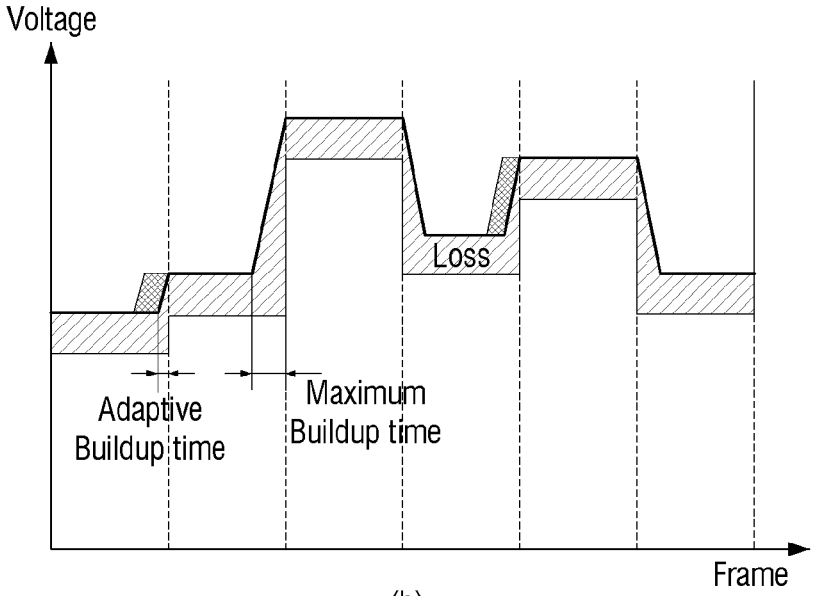

FIG. 15 is a pair of graphs illustrating a method for supplying power according to another exemplary embodiment.

Referring to graph (a) and graph (b) of FIG. 15, a voltage level required for each image frame is reflected to supply a voltage ELVDD. In particular, the device 1400 of FIG. 14 respectively checks R, G, and B values of frame data to calculate a maximum current value, converts a DC voltage to a DC voltage having a voltage level corresponding to the maximum current value, and supplies the converted DC voltage. In an exemplary embodiment, the DC voltage supplied by the device 1400 may be a voltage level corresponding to a maximum current value which is corrected based on temperature information relating to the panel unit.

If graph (a) and graph (b) of FIG. 15 are compared to each other, it is seen that a power efficiency of the device 1400 of FIG. 14 has a greater increase than the power efficiency of a conventional power supply device.

Further, a buildup time required for a conversion job between voltage levels is estimated to start the conversion job before the buildup time based on an output timing of back one of two image frames. Therefore, a buildup time required for a conversion job between voltage levels required for consecutive frames is estimated to further improve power efficiency.

Figure 16:
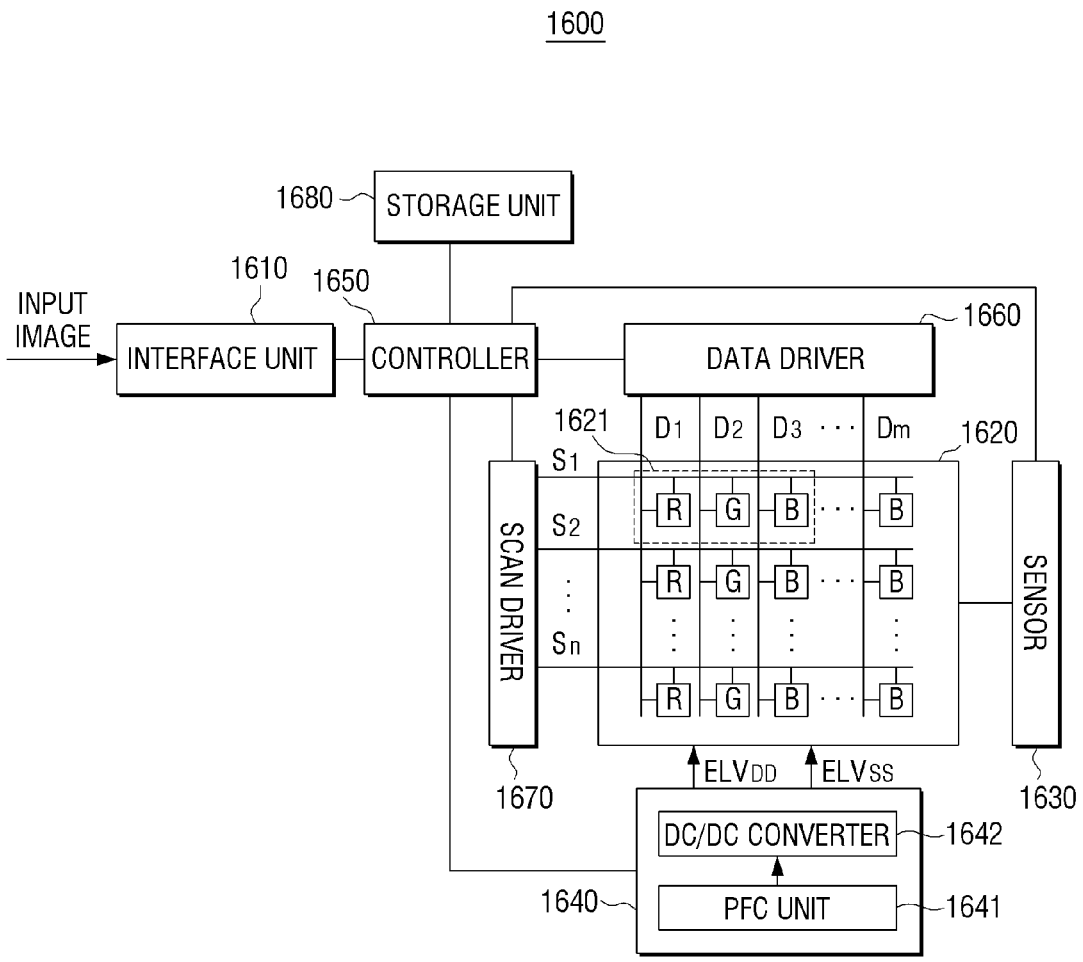
FIG. 16 is a block diagram which illustrates an organic light-emitting display device according to an exemplary embodiment.

FIG. 16 is a block diagram which illustrates an organic light-emitting display device 1600 according to an exemplary embodiment.

Referring to FIG. 16, the organic light-emitting display device 1600 includes an interface unit 1610, a panel unit 1620, R, G, and B pixels 1621, a sensor 1630, a voltage supply unit 1640, a controller 1650, a data driver 1660, a scan driver 1670, and a storage unit 1680. Descriptions of FIG. 16 overlapping with the descriptions of FIG. 14 will be omitted herein.

A driving method which is executed by the organic light-emitting display device 1600 may be a passive matrix method or an active matrix method. However, the organic light-emitting display device 1600 according to the present exemplary embodiment may be driven according to the active matrix method.

An R, G, B display method which is executed by the organic light-emitting display device 1600 may be an independent pixel method, a color conversion method (CCM), or a color filter method. However, the organic light-emitting display device 1600 may use the independent pixel method.

The interface unit 1610 receives an image signal. In detail, the interface unit 1610 may receive a plurality of pieces of image frame data which constitute image data. In particular, each of the pieces of image frame data has R, G, and B components. The interface unit 1610 transmits the received image signal to the controller 1650. If the image signal is received, the controller 1650 transmits the received image signal to the data driver 1660.

The panel unit 1620 displays a screen corresponding to the image signal received via the interface unit 1610.

In particular, the panel unit 1620 may include a plurality of pixels which include OLEDs. Each of the pixels may include a plurality of scan lines S1, S2, . . . , and Sn which are arranged in a column and transmit scan signals, and a plurality of data lines D1, D2, D3 . . . , and Dm which are arranged in a row and transmit data. Further, each of the pixels may receive voltages ELVDD and ELVSS from the power supply unit 1640. The plurality of pixels, which include the OLEDs, emit light in response to a flow of current based on operations of the scan lines S1, S2, . . . , and Sn and the data lines D1, D2, D3, . . . , and Dm.

More particularly, the panel unit 1620 may include a plurality of unit OLED pixels.

If the R, G, and B display method which is executed by the organic light-emitting display device 1600 is the independent pixel method, the panel unit 1620 may include a plurality of pixels which include R, G, and B OLEDs and are sequentially arranged.

The sensor 1630 senses a temperature of the panel unit 1620. In detail, the organic light-emitting display device 1600 generates heat based on its use. In particular, the panel unit 1620, which includes the OLEDs, generates a large amount of heat. Therefore, the sensor 1630 is formed around the panel unit 1620 to sense the temperature of the panel unit 1620. The sensor 1630 also transmits the sensed temperature to the controller 1650.

In particular, the sensor 1630 may be realized as a temperature sensor.

The voltage supply unit 1640 supplies a DC voltage to the plurality of pixels which constitute the panel unit 1620.

In detail, under control of the controller 1650, the voltage supply unit 1640 may convert a voltage ELVDD to a DC voltage having a voltage level corresponding to a calculated maximum current value and supply the converted DC voltage to the panel unit 1620.

Further, under control of the controller 1650, the voltage supply unit 1640 may start a conversion job before a buildup time based on an output timing of back one of two image frames by using a calculated buildup time.

In addition, under control of the controller 1650, the voltage supply unit 1640 may convert a voltage ELVDD to a DC voltage having a voltage level corresponding to a maximum current value which is corrected based on temperature information relating to the panel unit 1620 and supply the converted DC voltage to the panel unit 1620.

The voltage supply unit 1640 may supply a voltage ELVSS.

In particular, the voltage supply unit 1640 includes a PFC unit 1641 and a DC/DC converter 1642 which supplies DC power.

In detail, the PFC unit 1641 corrects a power factor of an input voltage and outputs the voltage having the correct power factor to the DC/DC converter 1642.

The DC/DC converter 1642 supplies a DC voltage. In particular, the DC/DC converter 1642 may receive a voltage having a corrected power factor from the PFC unit 1641 and convert the voltage to a DC voltage required for an organic light-emitting display device under control of the controller 1650 which will be described below.

The controller 1650 controls an overall operation of the organic light-emitting display device 1600. In detail, the controller 1650 may control the interface unit 1610, the panel unit 1620, the sensor 1630, the voltage supply unit 1640, the data driver 1660, and the scan driver 1670.

The controller 1650 may also control the voltage supply unit 1640 to respectively check R, G, and B values of image frame data received through the interface unit 1610 to calculate a maximum current value, convert a DC voltage to a DC voltage having a voltage level corresponding to the maximum current value, and supply the converted DC voltage to the panel unit 1620.

The controller 1650 may respectively calculate maximum current values corresponding to R, G, and B values of two consecutive image frames, calculate a difference between voltage levels corresponding to the maximum current values, and estimate a buildup time required for a conversion job between the voltage levels. Therefore, the controller 1650 may control the DC/DC converter 1642 to start a conversion jot before the buildup time based on an output timing of back one of two image frames.

The controller 1650 may also control the voltage supply unit 1640 to correct a maximum current value based on temperature information relating to the panel unit 1620 sensed by the sensor 1630, convert a DC voltage to a DC voltage having a voltage level corresponding to the corrected maximum current value, and supply the converted DC voltage to the panel unit 1620.

In particular, the controller 1650 may convert an output DC voltage of the DC/DC converter 1642 by using a digital control method such as a PWM, a PFM, or the like.

The controller 1650 may control the storage unit 1680 to store the maximum current value corrected based on the temperature information, the voltage level corresponding to the corrected maximum current value, and the buildup time.

The data driver 1660 receives an image signal (e.g., RGB video data) having R, G, and B components to generate a data signal. In particular, the data driver 1660 is connected to the data lines D1, D2, D3, . . . , and Dm of the plurality of pixels 1621 of the panel unit 1620 to provide the generate data signal to the plurality of pixels 1621.

The scan driver 1670 provides a scan signal to a particular line of the plurality of pixels 1621. In particular, the scan driver 1670 is connected to the scan lines S1, S2, . . . , and Sn of the plurality of pixels 1621 of the panel unit 1620 to provide the generated scan signal to the plurality of pixels 1621. A data signal which is outputted from the data driver 1660 is transmitted to the pixel to which the scan signal has been transmitted, such that a driving current is generated from the corresponding pixel and flows in the organic light-emitting display device 1600.

In particular, in order to process a plurality of frames and display the processed frames on the panel unit 1620, the organic light-emitting display device 1600 may include the controller 1650 which controls the voltage supply unit 1640 to adaptively vary and supply the driving voltage applied to the panel unit 1620 for displaying each frame data based on color information relating to the frame data.

The organic light-emitting display device 1600 according to the present exemplary embodiment may control a PFC unit to be turned off in a data voltage charging section to acquire a gain by power consumed by the PFC unit for the data voltage charging section. Therefore, power efficiency may be improved.

The organic light-emitting display device 1600 may respectively check R, G, and B values of image frame data to calculate a maximum current value, convert a DC voltage to a DC voltage having a voltage level corresponding to the maximum current value, and supply the converted DC voltage in order to improve power efficiency.

Further, the organic light-emitting display device 1600 may estimate a buildup time required for a conversion job between voltage levels required for each frame to improve power efficiency.

In addition, the organic light-emitting display device 1600 may consider an effect of rises in temperatures of OLEDs to improve power efficiency and represent accurate gradations.

Figure 17:
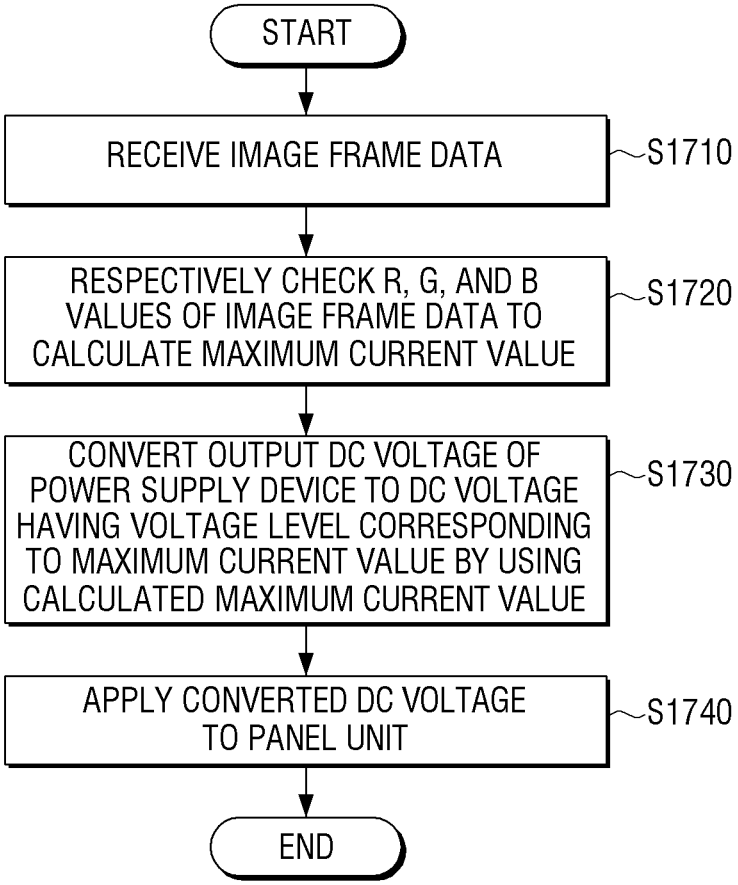
FIG. 17 is a flowchart which illustrates a method for supplying power according to another exemplary embodiment.

FIG. 17 is a flowchart which illustrates a method for supplying power according to another exemplary embodiment.

Referring to FIG. 17, in operation S1710, image frame data is received.

In operation S1720, R, G, and B values of image frame data are respectively checked to calculate a maximum current value. In addition, maximum current values corresponding to R, G, and B values of two consecutive image frames may be respectively calculated and a difference between voltage levels corresponding to the maximum current values may be calculated to estimate a buildup time required for a conversion job between voltage levels.

In operation S1730, an output DC voltage of the device is converted to a DC voltage having a voltage level corresponding to the maximum current value by using the calculated maximum current value. If the buildup time is estimated, a conversion job may be performed before the buildup time based on an output timing of back one of two image frames. Further, if the maximum current value is corrected based on temperature information, the output DC voltage may be converted to a DC voltage having a voltage level corresponding to the corrected maximum current value.

In operation S1740, the converted DC voltage is applied to a panel unit.

According to the above-described various exemplary embodiments, R, G, and B values of image frame data may be respectively checked to calculate a maximum current value. Further, a DC voltage may be converted to a DC voltage having a voltage level corresponding to the maximum current value and then supplied, thereby improving power efficiency.

In addition, a buildup time required for a conversion job between voltage levels required for consecutive frames may be estimated to improve the power efficiency.

Moreover, an effect of rises in temperatures of OLEDs may be considered to improve the power efficiency and represent accurate gradation.

Figure 18:
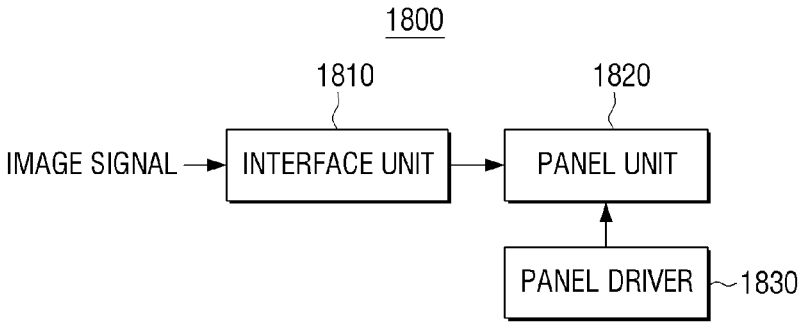
FIG. 18 is a block diagram which illustrates an organic light-emitting display device according to another exemplary embodiment.

FIG. 18 is a block diagram which illustrates an organic light-emitting display device 1800 according to another exemplary embodiment.

Referring to FIG. 18, the organic light-emitting display device 1800 includes an interface unit 1810, a panel unit 1820, and a panel driver 1830.

In particular, a driving method which is executed by the organic light-emitting display device 1800 may be a passive matrix method or an active matrix method. However, the organic light-emitting display device 1800 may be driven according to the active matrix method.

An RGB display method which is executed by the organic light-emitting display device 1800 may be an independent pixel method, a CCM, or a color filter method. However, the organic light-emitting display device 1800 may use the independent pixel method.

The interface unit 1810 receives an image signal. In particular, the interface unit 1810 may receive an image signal having R, G, and B components.

The panel unit 1820 displays an image frame corresponding to the image signal received via the interface unit 1810.

In particular, the panel unit 1820 may include a plurality of pixels which include OLEDs. More particularly, each of the pixels may include a plurality of scan lines S1, S2, . . . , and Sn which are arranged in a column and transmit a scan signal, and a plurality of data lines D1, D2, D3, . . . , and Dm which are arranged in a row and transmit a data signal. Further, each of the pixels may receive voltages ELVDD and ELVSS from the panel driver 1830. The plurality of pixels including the OLEDs emit light in response to a flow of a current based on operations of the scan lines S1, S2, . . . , and Sn, the data lines D1, D2, D3, . . . , and Dm, and the voltages ELVDD and ELVSS.

In an exemplary embodiment, the panel unit 1820 may include a plurality of unit OLED pixels.

In particular, if the RGB display method which is executed by the organic light-emitting display device 1800 is the independent pixel method, the panel unit 1820 may include a plurality of pixels which include R, G, and B OLEDs and are sequentially arranged.

The panel driver 1830 simultaneously supplies a plurality of powers to the panel unit 1820 to drive the panel unit 1820 in order to display the image frame corresponding to the image signal received via the interface unit 1810.

In detail, the panel driver 1830 may supply the panel unit 1820 with the voltage ELVDD having a level which varies based on colors of the OLEDs of the pixels. In particular, the panel driver 1830 may supply first power to a pixel which includes the R OLED and second power which is greater than the first power to a pixel which includes the B OLED. Further, the panel driver 1830 may supply third power which is greater than the first power and less than the second power to a pixel which includes the G OLED.

In particular, the first, second, and third powers denote power ELVDD.

In general, the voltage ELVDD required by the pixel which includes the R OLED, the pixel which includes the G OLED, and the pixel which includes the B OLED may vary based on gradation levels. However, the voltage ELVDD required by the pixel which includes the B OLED is the greatest, and the voltage ELVDD required by the pixel which includes the R OLED is the least. For example, the pixel which includes the B OLED generally requires a voltage of about 11V, the pixel which includes the G OLED generally requires a voltage of about 10V, and the pixel which includes the R OLED generally requires a voltage of about 7V.

Conventionally, a voltage ELVDD of 12V is provided to conventional R, G, and B OLEDs without distinguishing the R, G, and B OLEDs from one another. Therefore, the pixel (in detail, a driving transistor) which includes the B OLED generally loses about 1V, the pixel which includes the G OLED generally loses about 2V, and the pixel which includes the R OLED generally loses about 5V. Therefore, power efficiency is decreased. In general, a conventional panel unit has a power efficiency of about 80%.

Therefore, the panel driver 1830 supplies the voltage ELVDD of 8V to the pixel which includes the R OLED, the voltage ELVDD of 11V to the pixel which includes the G OLED, and the voltage ELVDD of 12V to the pixel which includes the B OLED. As a result, power efficiency of the panel unit 1820 may be improved. If the above-described method is used, the power efficiency may be approximately equal to 91%.

The panel driver 1830 may also supply a voltage ELVSS.

In particular, the panel driver 1830 may include a voltage supply unit (not shown), a data driver (not shown), and a scan driver (not shown). This will be described below with reference to FIG. 20.

Figure 19:
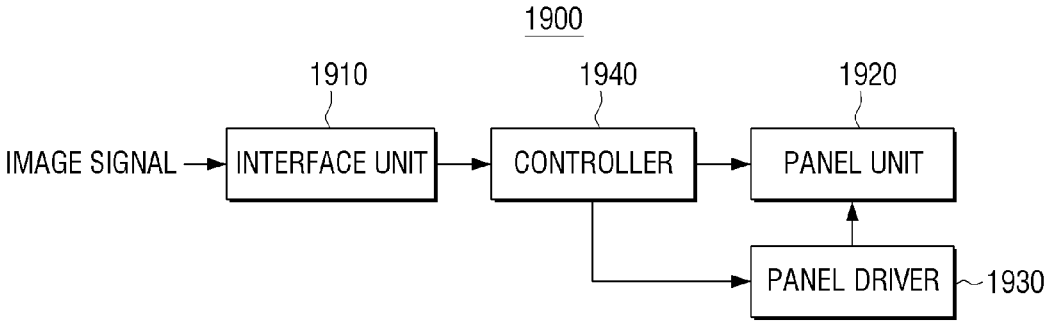
FIG. 19 is a block diagram which illustrates an organic light-emitting display device according to another exemplary embodiment.

FIG. 19 is a block diagram which illustrates an organic light-emitting display device 1900 according to another exemplary embodiment.

Referring to FIG. 19, the organic light-emitting display device 1900 includes an interface unit 1910, a panel unit 1920, a panel driver 1930, and a controller 1940. Detailed descriptions of the same elements of FIG. 19 as those of FIG. 18 will be omitted herein.

The interface unit 1910 transmits a received image signal to the controller 1940. In particular, the received image signal may be an image signal having R, G, and B components.

The panel unit 1920 displays an image frame corresponding to the image signal received via the interface unit 1910.

The panel driver 1930 simultaneously supplies a plurality of powers to the panel unit 1920 to drive the panel unit 1920 in order to display the image frame corresponding to the image signal received via the interface unit 1910.

The controller 1940 controls an overall operation of the organic light-emitting display device 1900. In detail, the controller 1940 controls the interface unit 1910, the panel unit 1920, and the panel driver 1930.

The controller 1940 also controls the panel driver 1930 to divide a plurality of pixels into a plurality of pixel groups and selectively supply power having a varying level to each of the plurality of pixel groups based on the image signal received via the interface unit 1910. In particular, the controller 1940 controls the panel driver 1930 to detect gradation values of the pixels which are displaying the image frame of the image signal in order to determine a respective level of power supplied to each of the pixel groups based on sizes of the gradation values and to supply the power having the determined level to each of the pixel groups.

In particular, the controller 1940 analyzes the image frame of the image signal received via the interface unit 1910. Therefore, the controller 1940 detects R, G, and B maximum gradation values of each pixel group, calculates an amount of a current, which is to flow in R, G, and B OLEDs, by using the R, G, and B maximum gradation values, and determines power ELVDD to be supplied by using the calculated amount of the current. As a result, the controller 1840 controls the panel driver 1930 to supply power having a determined level to each of the pixel groups. Therefore, power efficiency of the panel unit 1920 is improved.

In an exemplary embodiment, the panel driver 1930 may include a voltage supply unit (not shown), a data driver (not shown), and a scan driver (not shown). This will be described below with reference to FIG. 20.

Figure 20:
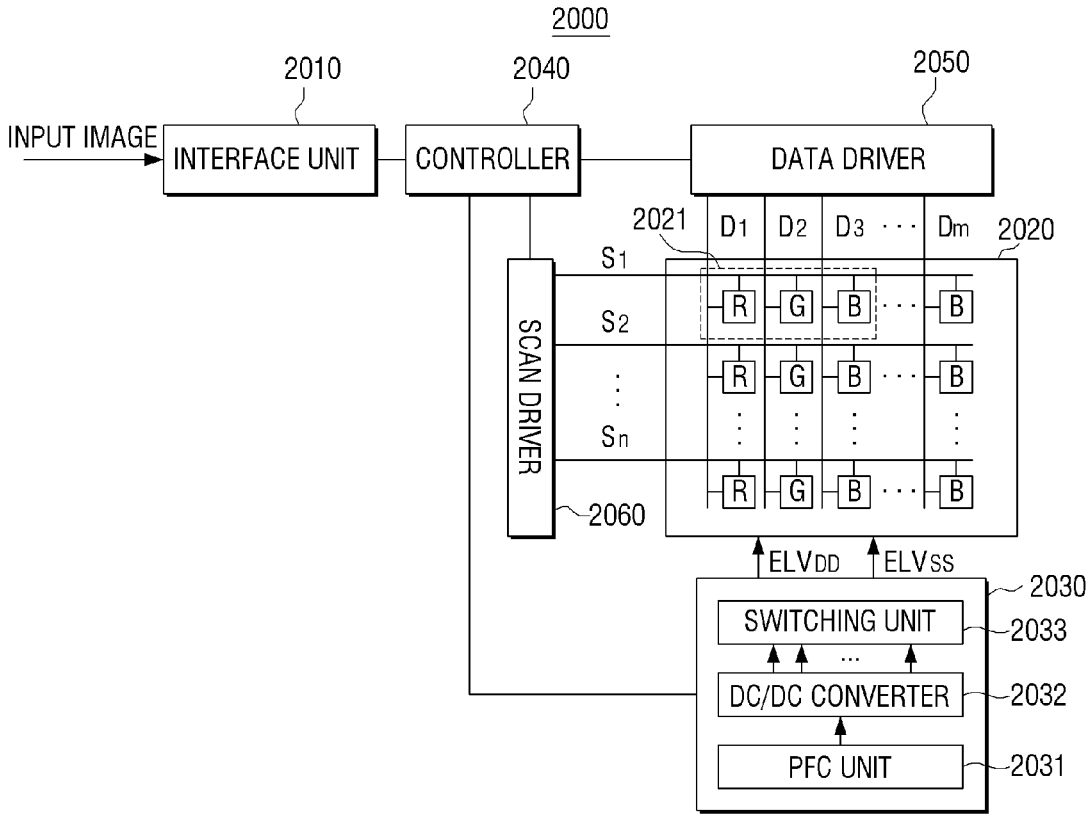
FIG. 20 is a detailed block diagram which illustrates the organic light-emitting display device of FIG. 18 or 19.

FIG. 20 is a detailed block diagram which illustrates an organic light-emitting display device 2000 as shown in FIGS. 18 and 19, according to another exemplary embodiment.

Referring to FIG. 20, the organic light-emitting display device 2000 includes an interface unit 2010, a panel unit 2020, R, G, and B pixels 2021, a voltage supply unit 2030, a controller 2040, a data driver 2050, and a scan driver 2060. The voltage supply unit 2030 includes a PFC unit 2031, a DC/DC converter 2032, and a switching unit 2033. Detailed descriptions of the same elements of FIG. 20 as those of FIGS. 18 and 19 will be omitted herein.

The interface unit 2010 receives an image signal having R, G, and B components and transmits the received image signal to the controller 2040. If the image signal is received, the controller 2040 transmits the received image signal to the data driver 2050.

The panel unit 2020 displays an image frame corresponding to the image signal received via the interface unit 2010. In particular, the plurality of pixels 2021 of the panel unit 2020 includes a plurality of scan lines S1, S2, . . . , and Sn which are arranged in a column and transmit a scan signal, and a plurality of data lines D1, D2, D3, . . . , and Dm which are arranged in a row and transmit a data signal. Further, each of the pixels 2021 receives voltages ELVDD and ELVSS from the voltage supply unit 2030.

The voltage supply unit 2030 supplies power to the plurality of pixels 2021 of the panel unit 2020.

In detail, the voltage supply unit 2030 supplies the panel unit 2020 with power ELVDD having a level which varies based on colors of OLEDs of each of the pixels 2021. In particular, the voltage supply unit 2030 supplies first power to a pixel which includes an R OLED and second power which is greater than the first power to a pixel which includes a B OLED. The voltage supply unit 2030 supplies power which is greater than the first power and less than the second power to a pixel which includes a G OLED.

The voltage supply unit 2030 selectively supplies power having a varying level to each of a plurality of pixel groups based on the received image signal.

The voltage supply unit 2030 supplies power ELVSS.

In particular, the voltage supply unit 2030 includes the PFC unit 2031, the DC/DC converter 2032 which supplies DC power having a varying level, and the switching unit 2033.

In detail, the PFC unit 2031 corrects a power factor of input power and outputs the power having the corrected power factor to the DC/DC converter 2032. More particularly, the PFC unit 2031 may be positioned next to a rectifier (not shown). If input AC power is rectified by the rectifier to generate DC power, the PFC unit 2031 may correct a power factor of the DC power and output the DC power having the corrected power factor to the DC/DC converter 2032. In general, an output of the PFC unit 2031 may be approximately equal to 2000V in the organic light-emitting display device.

In an exemplary embodiment, the PFC unit 2031 is added as a power saving circuit in order to improve power efficiency of the voltage supply unit 2030 and adjusts power supplied to a transformer, a stabilizer, and/or any other relevant type of component from which an instantaneous power leak is concerned. In particular, the PFC unit 2031 reduces power consumption and prevents a temperature from rising due to a change of a current to heat in order to improve power efficiency. In general, the power efficiency of the PFC unit 2031 may be approximately equal to 95%.

In an exemplary embodiment, the PFC unit 2031 may have a boost topology.

The DC/DC converter 2032 supplies different types of DC power. In particular, the DC/DC converter 2032 receives power having a corrected power factor from the PFC unit 2031 and converts the power to a plurality of powers required for the organic light-emitting display device 2000. In general, power efficiency of the DC/DC converter 2032 may be approximately equal to 94%.

In an exemplary embodiment, the DC/DC converter 2032 may be constituted by using a conventional DC/DC converter circuit.

The switching unit 2033 selects an output of the DC/DC converter 2032. In detail, the switching unit 2033 switches the output of the DC/DC converter 2032 to supply power ELVDD under control of the controller 2040. In this case, the power ELVDD may be determined in response to an amount of a current flowing in each pixel.

The switching unit 2033 also switches the output of the DC/DC converter 2032 to supply power ELVSS.

In particular, the voltage supply unit 2030 supplies the power ELVDD and the power ELVSS to a plurality of pixels of the panel unit 2020 and supplies driving power to all elements (e.g., a data driver (not shown) and a scan driver (not shown)) which constitute the organic light-emitting display device 2000 and require power.

The controller 2040 controls the voltage supply unit 2030 to supply a plurality of powers to the panel unit 2020 in order to drive a plurality of pixels.

In detail, the controller 2040 controls the voltage supply unit 2030 to divide the plurality of pixels into a plurality of pixel groups and to selectively supply powers having different levels to each respective one of the plurality of pixel groups based on the image signal received via the interface unit 2010. In particular, the controller 2040 controls the voltage supply unit 2030 to detect gradation values of pixels which are displaying the image frame of the image signal to determine a level of power supplied to each of the pixel groups based on sizes of the gradation values and to supply the power having the determined level to each of the pixel groups.

In an exemplary embodiment, the controller 2040 controls a switching operation of the switching unit 2033 to select power supplied by the voltage supply unit 2040.

The data driver 2050 receives an image signal (RGB video data) having R, G, and B components to generate a data signal. In particular, the data driver 2050 is connected to the data lines D1, D2, D3, . . . , and Dm of the plurality of pixels 2021 of the panel unit 2020 to provide the generated data signal to the plurality of pixels 2021.

The scan driver 2060 provides a scan signal to a particular line of the plurality of pixels 2021. In particular, the scan driver 2060 is connected to the scan lines S1, S2, . . . , and Sn of the plurality of pixels 2021 of the panel unit 2020 to provide the generated scan signal to the plurality of pixels 2021. The data signal outputted from the data driver is transmitted to the pixel to which the scan signal has been transmitted, such that a driving current is generated in the pixel to flow in OLEDs.

The organic light-emitting display device 2000 according to the above-described present exemplary embodiment constitutes a voltage supply unit in a 2-step power conversion structure and analyzes a received image signal in order to control power supplied to each pixel or each block that includes a plurality of pixels. Therefore, the organic light-emitting display device 2000 has a total power efficiency which is approximately equal to 81.2%, which is considerably greater than a power efficiency of 65.7% of a conventional organic light-emitting display device.

Figure 21:
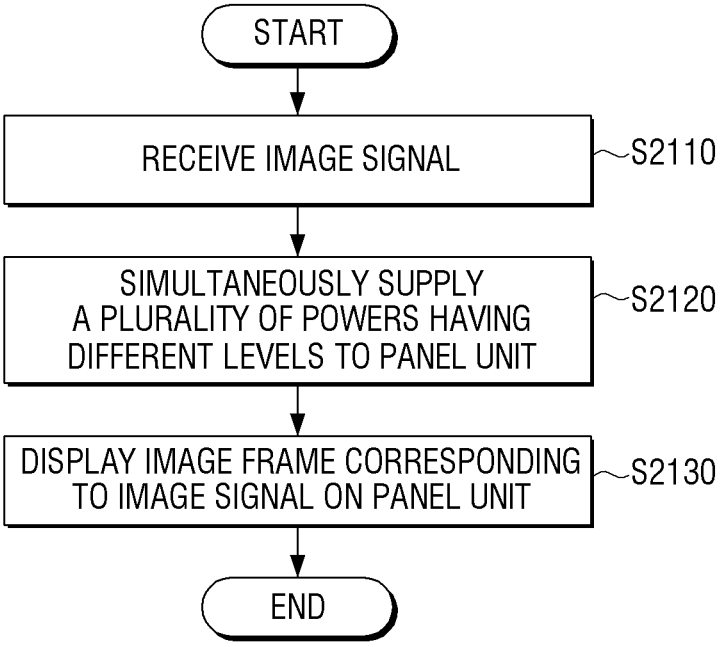
FIG. 21 is a flowchart which illustrates a method for displaying an image according to another exemplary embodiment.

FIG. 21 is a flowchart which illustrates a method for displaying an image according to an exemplary embodiment.

Referring to FIG. 21, in operation S2110, an image signal is received.

In operation S2120, a plurality of powers having different levels are simultaneously supplied to a panel unit.

In operation S2130, an image frame corresponding to the received image signal is displayed on the panel unit.

Figure 22:
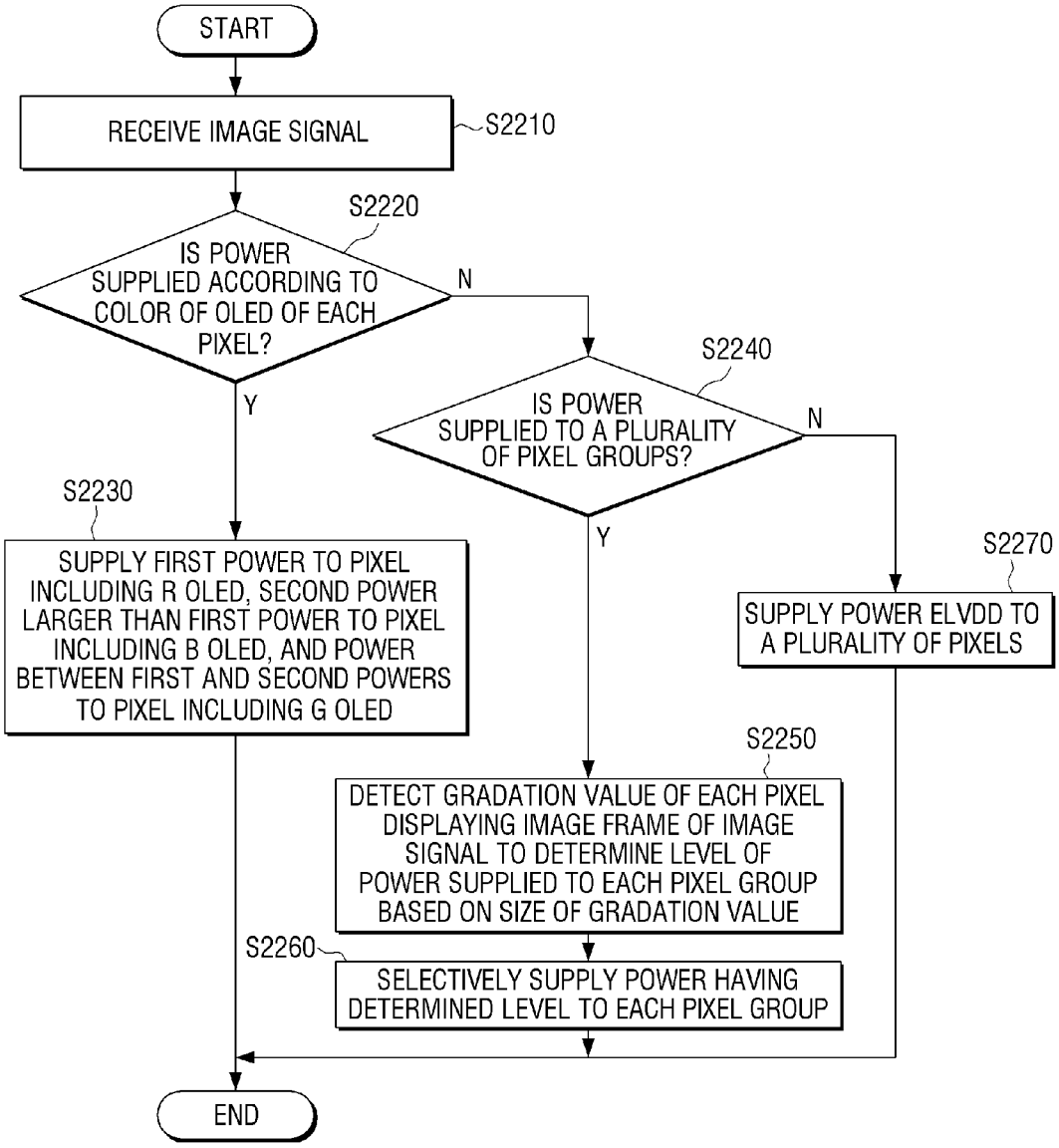
FIG. 22 is a flowchart which illustrates the method of FIG. 21 in detail.

FIG. 22 is a flowchart which illustrates the method of FIG. 21 in more detail.

Referring to FIG. 22, in operation S2210, the image signal is received.

In operation S2220, a determination is made as to whether power is supplied based on colors of OLEDs of each pixel. If it is determined in operation S2220 that the power is supplied based on the colors of the OLEDs of each pixel, then in operation S2230, first power is supplied to a pixel which includes an R OLED, second power which is greater than the first power is supplied to a pixel which includes a B OLED, and power which is greater than the first power and less than the second power is supplied to a pixel which includes a G OLED. If it is determined in operation S2220 that the power is not supplied based on the colors of the OLEDs of each pixel, then in operation S2240, a determination is made as to whether power is supplied to each of a plurality of pixel groups. If it is determined in operation S2240 that the power is supplied to each of the plurality of pixel groups, then in operation S2250, a gradation value of each pixel which is displaying an image frame of the image signal is detected to determine a level of power to be supplied to each of the plurality of pixel groups based on a size of the gradation value. In operation S2260, the power having the determined level is selectively supplied to each of the pixel groups. If it is determined in operation S2240 that the power is not supplied to each of the plurality of pixel groups, in operation S2270, the same voltage ELVDD is supplied to each of a plurality of pixels.

According to the above-described various exemplary embodiments, a voltage supply unit is constituted in a 2-step power conversion structure, and a received image signal is analyzed to control power supplied to each pixel or each block which includes a plurality of pixels. Therefore, a total of power efficiency of a system is improved, and a circuit is small-sized.

Figure 23A:
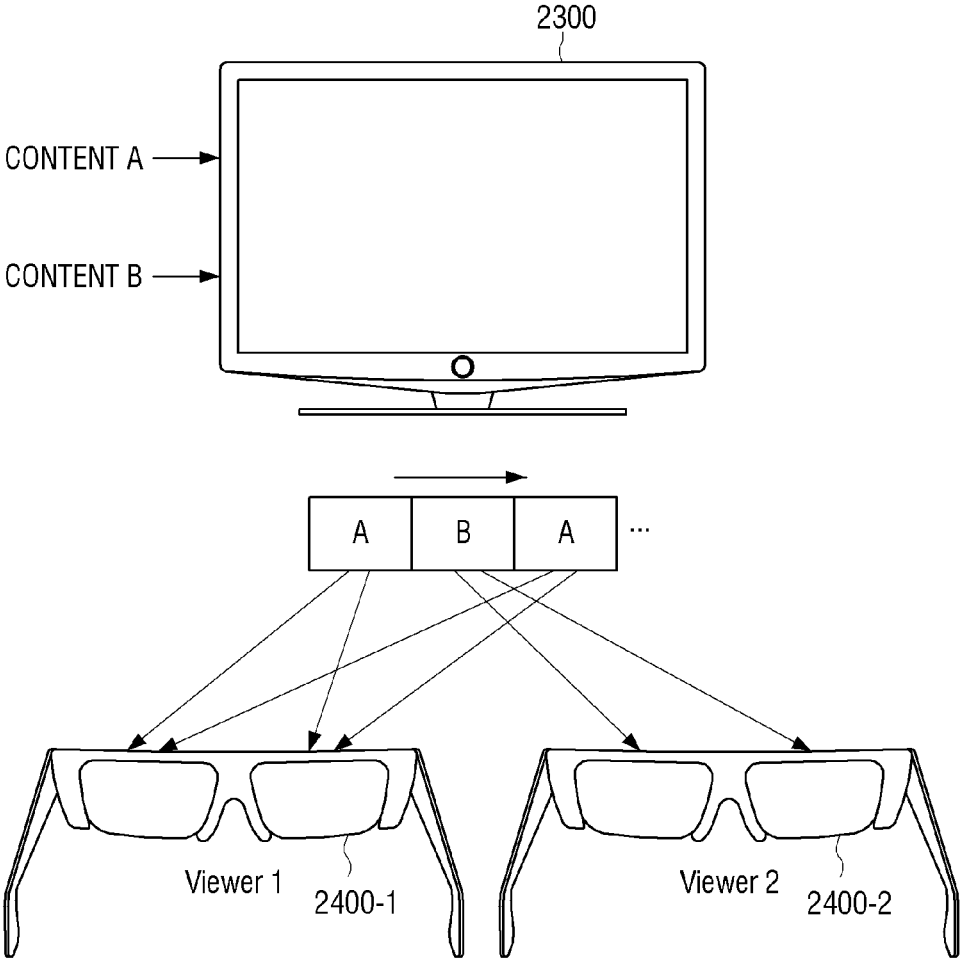
FIGS. 23A and 23B are views which illustrate a system for providing contents according to an exemplary embodiment.
Figure 23B:
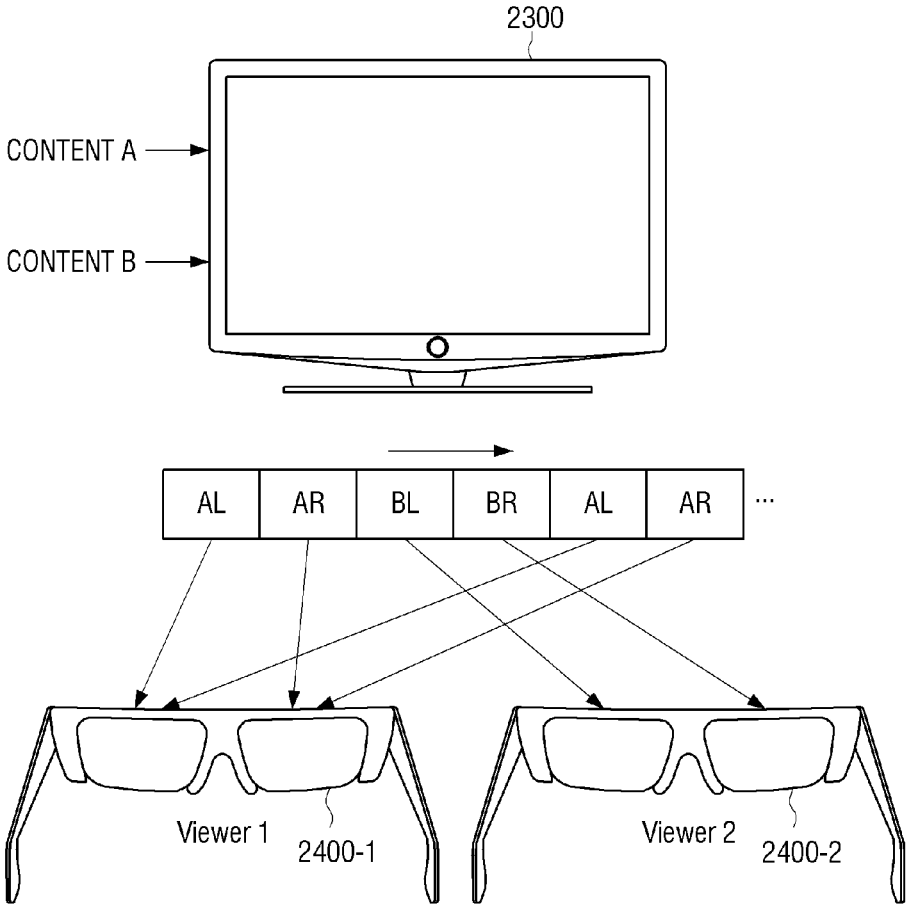

FIGS. 23A and 23B are views which illustrates a structure of a content providing system according to an exemplary embodiment.

As shown in FIGS. 23A and 23B, the content providing system according to the present exemplary embodiment includes an image display device 2300 and an eyeglass device 2400.

FIG. 23A is a view which illustrates a method for providing a plurality of 2-dimensional (2D) contents according to an exemplary embodiment.

The image display device 2300 alternately displays a plurality of 2D contents (i.e., contents A and B), generates a sync signal, and transmits the sync signal to first and second eyeglass devices 2400-1 and 2400-2 respectively in correspondence with the contents A and B. In particular, the sync signal synchronizes the first and second eyeglass devices 2400-1 and 2400-2 with each other.

In this case, based on the sync signal, the first eyeglass device 2400-1 opens both left and right shutter glasses when the content A is displayed and closes both the left and right shutter glasses when the content B is displayed. Therefore, a first viewer who wears the first eyeglass device 2400-1 views only the content A which synchronizes with the first eyeglass device 2400-1 among the alternately displayed contents A and B. According to the same method, a second viewer who wears the second eyeglass device 2400-2 views only the content B.

FIG. 23B is a view which illustrates a method for providing a plurality of 3-dimensional (3D) contents according to an exemplary embodiment.

As shown in FIG. 23B, if the plurality of 3D contents (i.e., 3D contents A and B) are 3D contents, the image display device 2300 alternately displays the plurality of 3D contents (i.e., contents A and B) and alternately displays left and right eye images of each of the 3D images.

For example, the image display device 2300 displays left and right eye images AL and AR of the 3D content A and alternately displays left and right eye images BL and BR of the 3D content B. In this case, the first eyeglass device 2400-1 opens left and right shutter glasses at a display time of the left and right eye images AL and AR of the 3D content A. Further, the second eyeglass device 2400-2 opens left and right shutter glasses at a display time of the left and right eye images BL and BR of the 3D content B.

Therefore, the first viewer who wears the first eyeglass device 2400-1 views only the 3D content A, and the second viewer who wears the second eyeglass device 2400-2 views only the 3D content B.

However, this describe a shutter glass method, and thus it will be apparent to those skilled in the art that polarization directions of a plurality of content images are realized to be equal to polarization directions of first and second eyeglass devices to support a multi-view mode in the case of a polarization method.

Figure 24A:
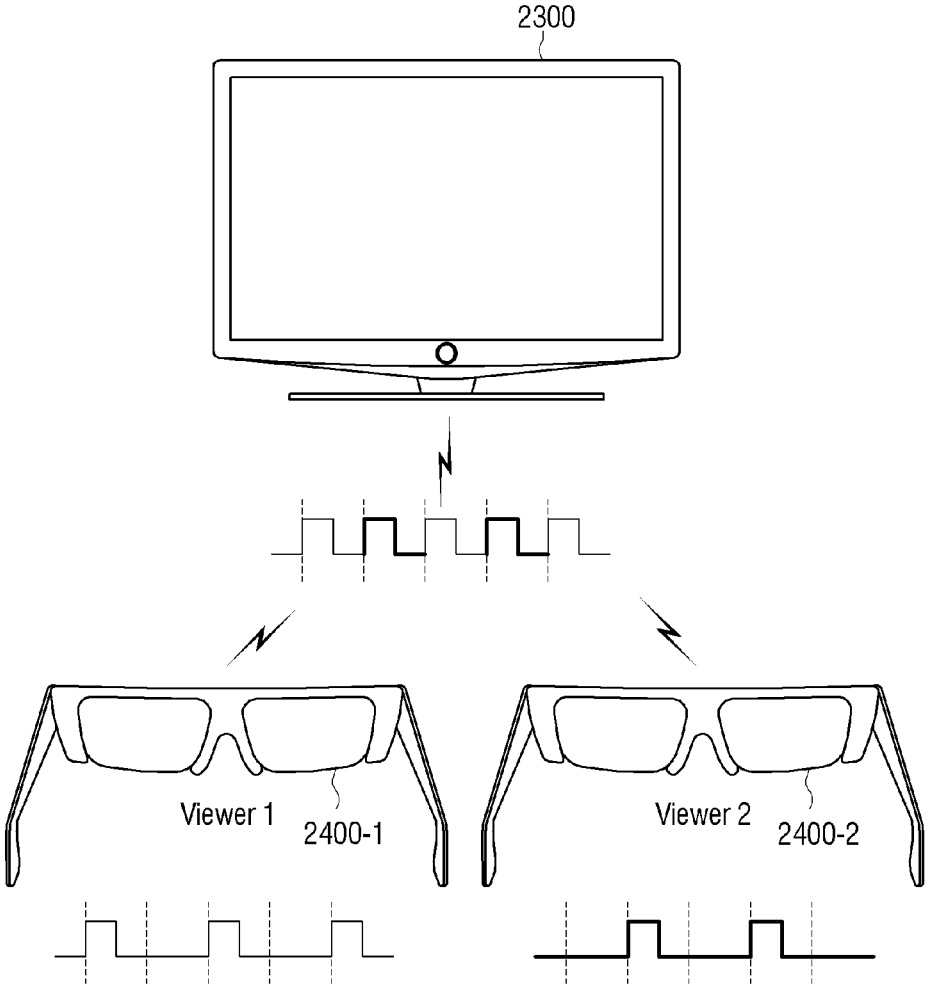
FIGS. 24A and 24B are views which illustrate methods for transmitting a sync signal according to various exemplary embodiments.
Figure 24B:
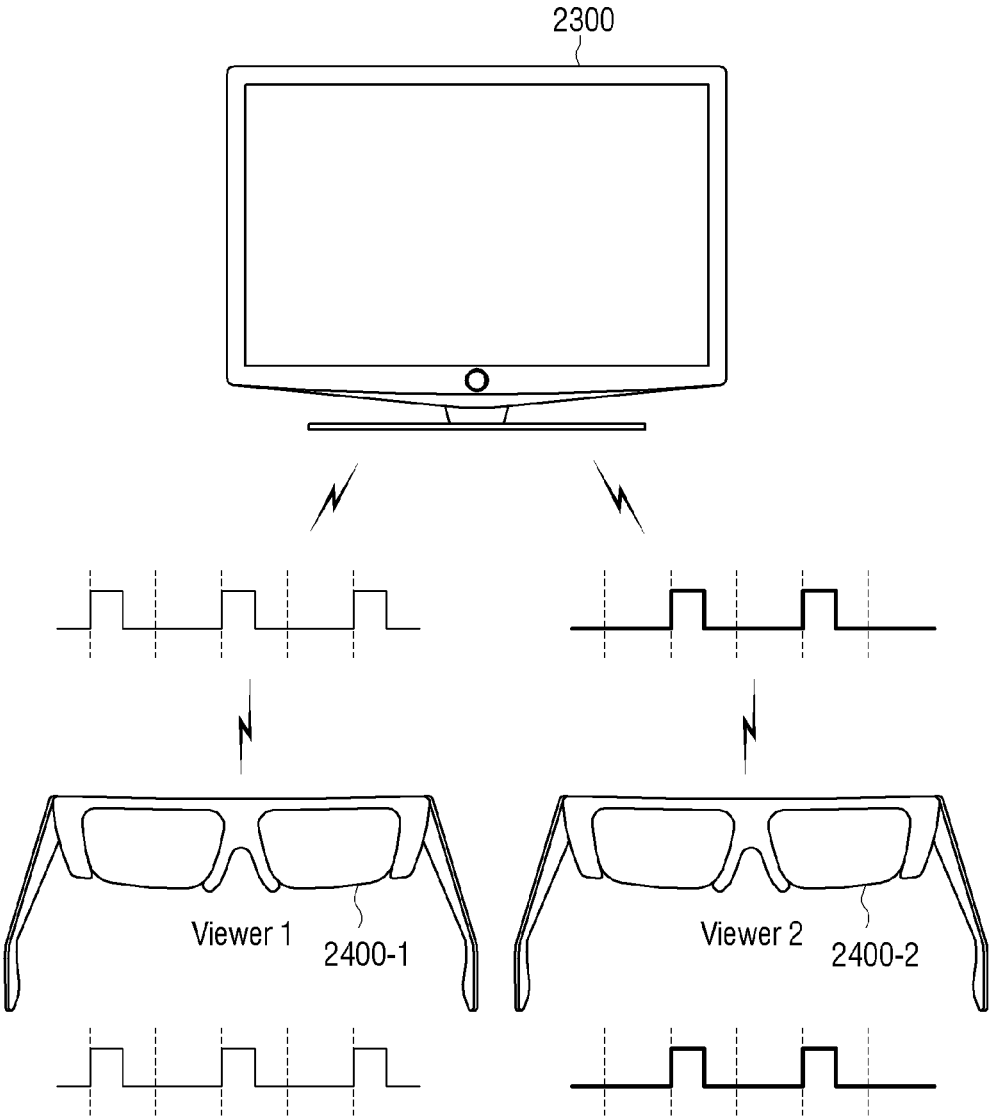

FIGS. 24A and 24B are views which illustrate methods for transmitting a sync signal according to various exemplary embodiments.

Referring to FIG. 24A, an image display device 2300 broadcasts or multicasts one of signals into which a sync signal corresponding to first and second eyeglass devices 2400-1 and 2400-2 is multiplied. The first and second eyeglass devices 2400-1 and 2400-2 synchronize with a sync signal corresponding to a user command (e.g., a channel change command) of the corresponding signal operate to open/close shutter glasses.

However, the present exemplary embodiment is only an example. Therefore, as shown in FIG. 24B, the image display device 2300 performs unicast with respect to each of the first and second eyeglass devices 2400-1 and 2400-2 to transmit a sync signal corresponding to the first and second eyeglass devices 2400-1 2400-2. Therefore, the corresponding one of the first and second eyeglass devices 2400-1 and 2400-2 receives the sync signal.

The sync signal may be realized in a radio frequency (RF) signal form or an infrared (IR) signal form, and its detailed description will be provided below.

Figure 25A:
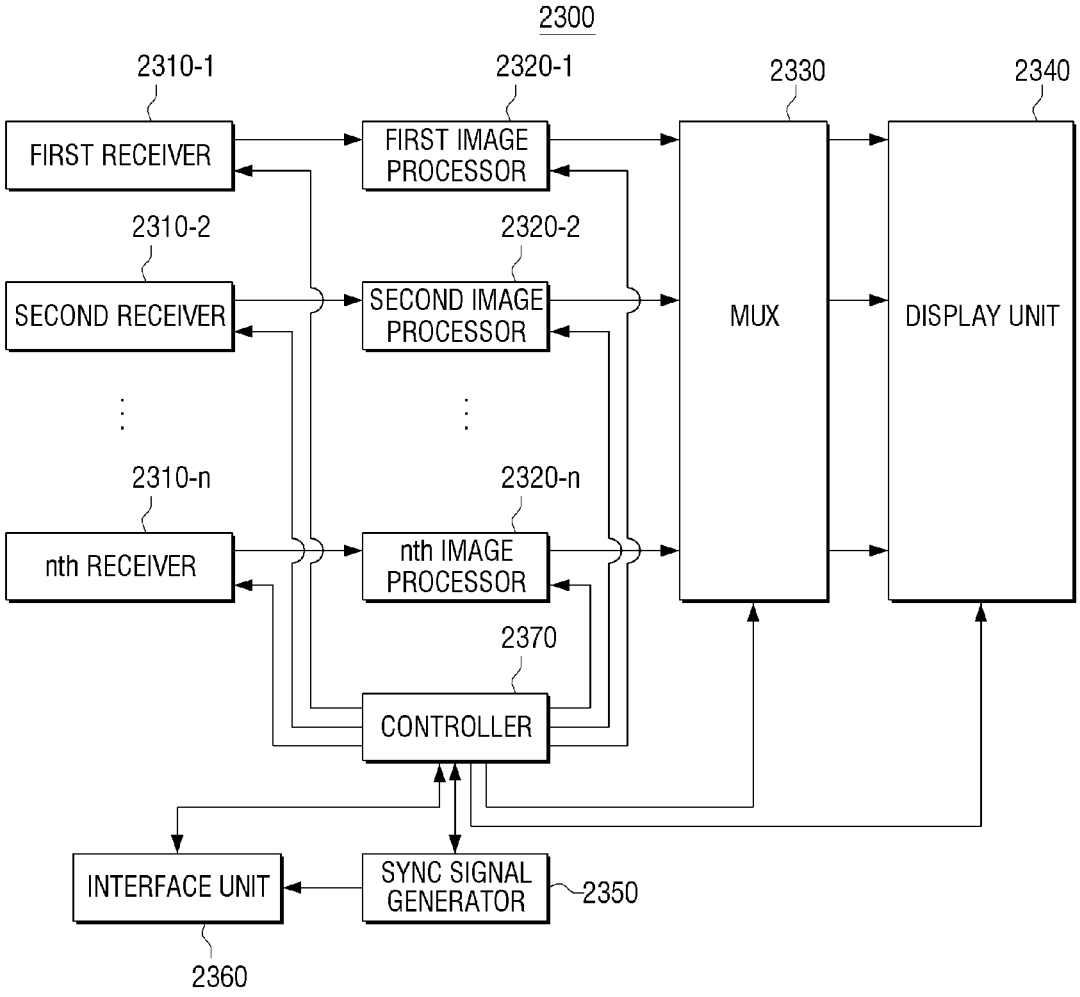
FIGS. 25A and 25B are block diagrams which illustrate structures of a device for displaying an image according to various exemplary embodiments.
Figure 25B:
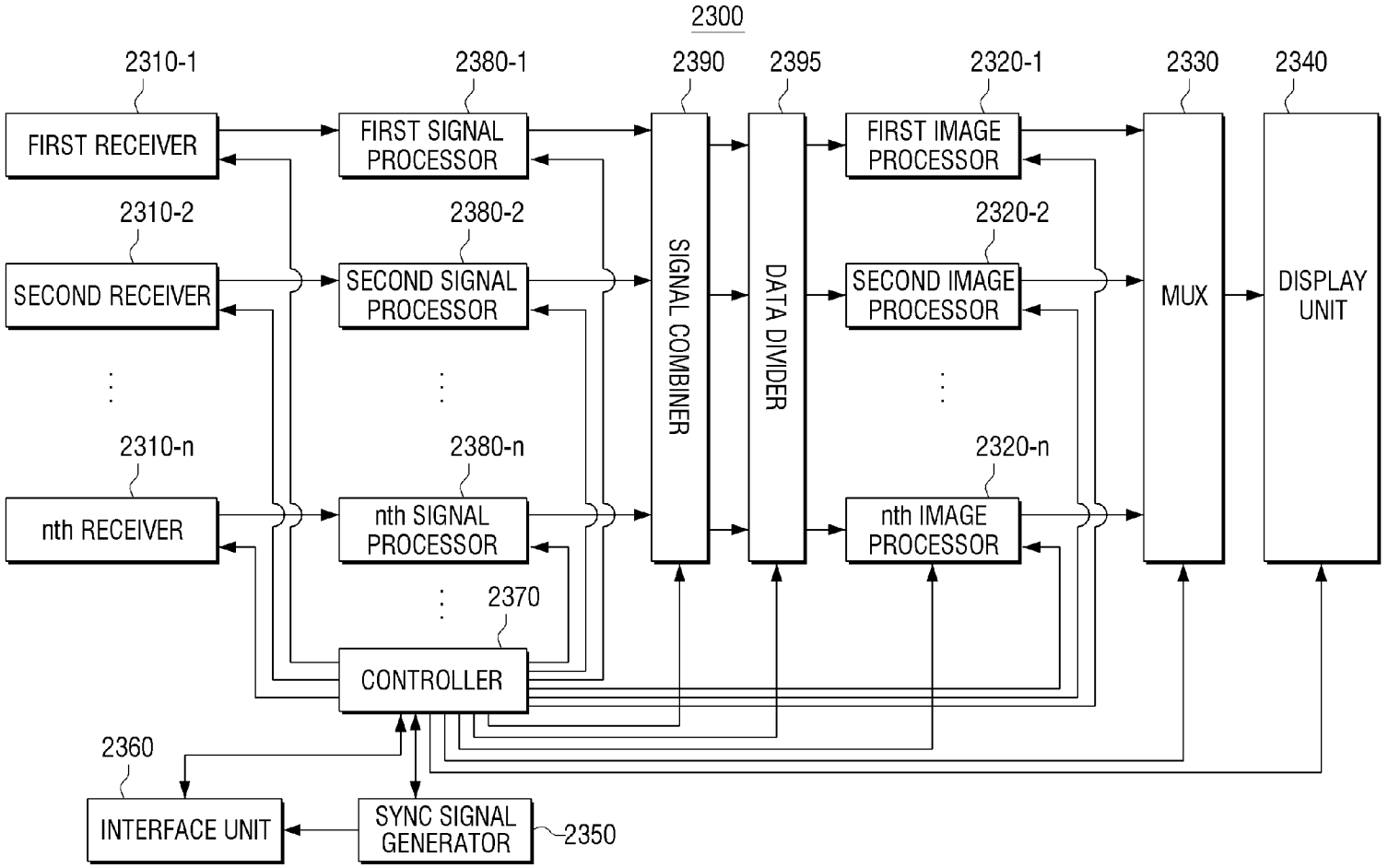

FIGS. 25A and 25B are block diagrams which illustrate a structure of an image display device 2300 according to various exemplary embodiments.

The image display device 2300 shown in FIGS. 25A and 25B may be realized as various types of devices, including, for example, a display unit such as a television (TV), a portable phone, a personal digital assistant (PDA), a notebook personal computer (PC), a monitor, a tablet PC, an e-book, an e-frame, kiosk, or the like.

FIG. 25A is a block diagram which illustrates a structure of the image display device 2300 according to an exemplary embodiment.

Referring to FIG. 25A, the image display device 2300 includes a plurality of receivers 2310-1, 2310-2, . . . , and **2310-*n*, a plurality of image processors 2320-1, 2320-2, . . . , and 2320-*n*, a multiplexer (MUX) 2330, a display unit 2340, a sync signal generator 2350, an interface unit 2360, and a controller 2370**.

Each of the plurality of receivers 2310-1, 2310-2, . . . , and **2310-*n* respectively receives different types of contents. In detail, each of the plurality of receivers 2310-1, 2310-2, . . . , and 2310-*n* respectively receives contents from a broadcasting station which transmits broadcast program contents by using a broadcast network or a web server which transmits content files by using the Internet. Each of the plurality of receivers 2310-1, 2310-2, . . . , and 2310-*n* may also receive contents from various types of recording medium players which are installed in or connected to the image display device 2300**. A recording medium player refers to a device which plays contents stored in various types of recording media such as a compact disk (CD), a digital video disk (DVD), a hard disk, a blue-ray disk, a memory card, a universal serial bus (USB) memory, and/or the like.

In an exemplary embodiment in which the plurality of receivers 2310-1, 2310-2, . . . , and **2310-*n* receives contents from a broadcasting station, the plurality of receivers 2310-1, 2310-2, . . . , and 2310-*n* may include elements such as tuners (not shown), demodulators (not shown), equalizers (not shown), etc. In an exemplary embodiment in which the plurality of receivers 2310-1, 2310-2, . . . , and 2310-*n* receives contents from a source such as web server, the plurality of receivers 2310-1, 2310-2, . . . , and 2310-*n*** may be realized as network interface cards (not shown). In an exemplary embodiment in which the plurality of receivers

2310-1, 2310-2, . . . , and **2310-*n* receive contents from the above-described various types of recording medium players, the plurality of receivers 2310-1, 2310-2, . . . , and 2310-*n* may be realized as interfaces (not shown) connected to a recording medium player. For example, the plurality of receivers 2310-1, 2310-2, . . . , and 2310-*n*** may be realized as AV terminals, COMP terminals, HDMI terminals, or the like.

As described above the plurality of receivers 2310-1, 2310-2, . . . , and **2310-*n*** may be realized in various forms according to exemplary embodiments.

The plurality of receivers 2310-1, 2310-2, . . . , and **2310-*n* do not need to receive contents from the same types of sources but may receive contents from different types of sources. For example, the first receiver 2310-1 may include a tuner, a demodulator, an equalizer, and/or any other relevant type of component, and the second receiver 2310-2** may be realized as a network interface card.

The plurality of image processors 2320-1, 2320-2, . . . , and **2320-*n* perform various types of image processing with respect to each of the contents received by the plurality of receivers 2310-1, 2310-2, . . . , and 2310-*n***.

In particular, the plurality of image processors 2320-1, 2320-2, . . . , and **2320-*n*** process the received contents in image frame forms and perform brightness adjustment processing with respect to each of a plurality of contents which are processed in frame forms.

In detail, the plurality of image processors 2320-1, 2320-2, . . . , and **2320-*n*** detect brightness information relating to each of image frames of a plurality of contents and adjust a brightness of the respective image frame of each of the plurality of contents by using a brightness adjustment gain having a size corresponding to a size relating to the brightness information.

The MUX 2330 multiplexes and outputs an image frame of a first content, an image frame of a second content, . . . , and an image frame of an nth content to alternately arrange the image frames at least one by one.

The display unit 2340 displays a plurality of contents based on data outputted from the MUX 2330. Therefore, the display unit 2340 displays image frames of the contents to alternately arrange the image frames at least one by one.

In particular, the display unit 2340 may be realized as an OLED display which is a self-emission display. However, one or more exemplary embodiments may be applied to a liquid crystal display (LCD) using a backlight unit (BLU) within an applicable range.

Although not shown in FIG. 25A, the image display device 2300 further includes an element which variably provides audio data relating to each of the contents based on users when the image display device 2300 operates in a multi-view mode. In particular, the image display device 2300 may further include a demultiplexer (not shown) which divides video data and audio data from the contents received by the receivers 2310-1, 2310-2, . . . , and **2310-*n***, an audio decoder (not shown) which decodes the audio data, a modulator (not shown) which modulates the decoded audio data into signals having different respective frequencies, an output unit (not shown) which transmits the modulated audio data to an eyeglass device, and/or other relevant components. Each audio data outputted from the output unit is provided to a user through an output means such as earphones installed in the eyeglass device. These elements are not directly related to exemplary embodiments of the present disclosure, and thus their additional illustrations will be omitted.

If the contents include electronic program guides (EPGs) and additional information such as subtitles, the demultiplexer may divide additional data from the contents. The image display device 2300 may add subtitles and/or other relevant information, which have been processed to be displayable, to a corresponding image frame through an additional data processor (not shown).

The sync signal generator 2350 generates a sync signal which synchronizes an eyeglass device corresponding to a content based on a display timing of the content. In particular, the sync signal generator 2350 generates a sync signal which synchronizes an eyeglass device at a display timing of an image frame of the content in a multi-view mode.

The interface unit 2360 transmits the sync signal to the eyeglass device. In this case, the interface unit 2360 may transmit the sync signal to the eyeglass device by using any of various methods.

For example, the interface unit 2360 may include an RF communication module to communicate with the eyeglass device. In particular, the RF communication module may be realized as a Bluetooth communication module. Therefore, the interface unit 2360 generates a transmission stream to include the sync signal in the transmission stream in accordance with Bluetooth communication standards and transmits the transmission stream to the eyeglass device.

More particularly, the transmission stream includes time information which synchronizes with the display timing of each content to open/close shutter glasses of the eyeglass device. In detail, the transmission stream may include information relating to an offset time which is used to turn on a left shutter glass of the eyeglass device from a reference time set with respect to each content, information relating to an offset time which is used to turn off the left shutter glass, information relating to an offset time which is used to turn on a right shutter glass, and information relating to an offset time which is used to turn off close the right shutter glass. In particular, the reference time refers to a time when a vertical sync signal is generated in an image frame of each content, and time information relating to the time when the vertical sync signal is generated may also be included in the transmission stream.

The interface unit 2360 performs pairing with each eyeglass device in order to perform communications based on a Bluetooth communication method. If the pairing is completed, information relating to each eyeglass device, e.g., a device ID (or address), and/or other relevant information, may be registered in the interface unit 2360. The interface unit 2350 matches the display timing of each content with the information relating to the eyeglass device to generate one transmission stream in accordance with the Bluetooth communication standards. For example, the interface unit 2360 may match each respective display time of a content with corresponding information relating to eyeglass devices based on an arrangement order of image frames of the contents. In particular, if two contents are alternately provided in a multi-view mode, image frames of the content arranged in first, third, . . . , and nth positions are matched with information relating to a first eyeglass device. Image frames of the content arranged in second, fourth, . . . , and n+1th positions are matched with information relating to a second eyeglass device. In this example, n is an odd number. If a sync signal is received, an eyeglass device may check a display timing corresponding to information relating to the eyeglass device and turn on or off shutter glasses based on the checked display timing.

Although the interface unit 2360 performs communications with the eyeglass device based on the Bluetooth communication method in the above-described exemplary embodiment, this is only an example. In particular, in addition to the Bluetooth communication method, an IR communication method, a Zigbee communication method, or the like may be used. Further, communications may be performed based on various wireless communication methods for forming a communication channel in a short range to transmit and receive a signal.

The interface unit 2360 may provide an IR sync signal having different frequencies to the eyeglass device. In this case, the eyeglass device may receive a sync signal having a particular frequency to turn on or off shutter glasses based on a display timing of a corresponding content.

In this case, the interface unit 2360 may transmit an IR signal to the eyeglass device. In this example, in the IR signal, a high level of a first period and a low level of a second period are alternated and repeated at preset time intervals based on sync information. The eyeglass device turns on the shutter glasses during the first period which is on the high level and turns off the shutter glasses during the second period which is on the low level. Further, the sync signal may be generated according to various methods.

The controller 2370 controls an overall operation of the image display device 2300. In detail, the controller 2370 controls the plurality of receivers 2310-1, 2310-2, . . . , and **2310-*n*, the plurality of image processors 2320-1, 2320-2, . . . , and 2320-*n*, the MUX 2330, the display unit 2340, the sync signal generator 2350, and the interface unit 2360 to perform corresponding operations. The operations of the elements of the image display device 2300** are as described above, and thus their repeated descriptions will be omitted herein.

FIG. 25B is a block diagram which illustrates a structure of an image display device 2300 according to another exemplary embodiment.

Referring to FIG. 25B, the image display device 2300 includes a plurality of receivers 2310-1, 2310-2, . . . , and **2310-*n*, a plurality of image processors 2320-1, 2320-2, . . . , and 2320-*n*, a MUX 2330, a display unit 2340, a sync signal generator 2350, an interface unit 2360, a controller 2370, a plurality of signal processors 2380-1, 2380-2, . . . , and 2380-*n*, a data combiner 2390, and a data divider 2395. Detailed descriptions of the same elements of FIG. 25B as those of FIG. 25**A will be omitted.

In particular, in the image display device 2300 of FIG. 25B, the plurality of signal processors 2380-1, 2380-2, . . . , and **2380-*n* which receive a plurality of contents and process the contents in image frame forms may be installed separately from the plurality of image processors 2320-1, 2320-2, . . . , and 2320-*n*** which perform brightness adjustment processing with respect to each of the plurality of contents processed in the image frame forms.

In this case, the plurality of contents processed in the image frame forms by using the plurality of signal processors 2380-1, 2380-2, . . . , and **2380-*n* may be combined through the data combiner 2390**.

Similarly as the MUX 2330 of FIG. 25A, the data combiner 2390 multiplexes and outputs image frames to alternately arrange an image frame of a first content, an image frame of a second content, . . . , and an image frame of an nth content at least one by one.

The data divider 2395 receives the plurality of contents, which have been combined in an image frame unit, from the data combiner 2390, divides an image frame of each of the plurality of contents, and provides each image frame to the plurality of image processors 2320-1, 2320-2, . . . , and **2320-*n***.

In detail, the data divider 2395 may divide each image frame from each of the plurality of contents based on at least one of an ID and an input order of each image frame.

Each of the plurality of image processors 2320-1, 2320-2, . . . , and **2320-*n*** respectively detects brightness information relating to the image frames of the plurality of contents and adjusts a corresponding brightness of one or more of the image frames of the plurality of contents by using brightness adjustment gains having sizes corresponding to a size relating to the brightness information.

The image display device 2300 according to the exemplary embodiment of FIG. 25B may be compatible with an existing image display device which multiplexes and outputs an image frame of each content.

Figure 26:
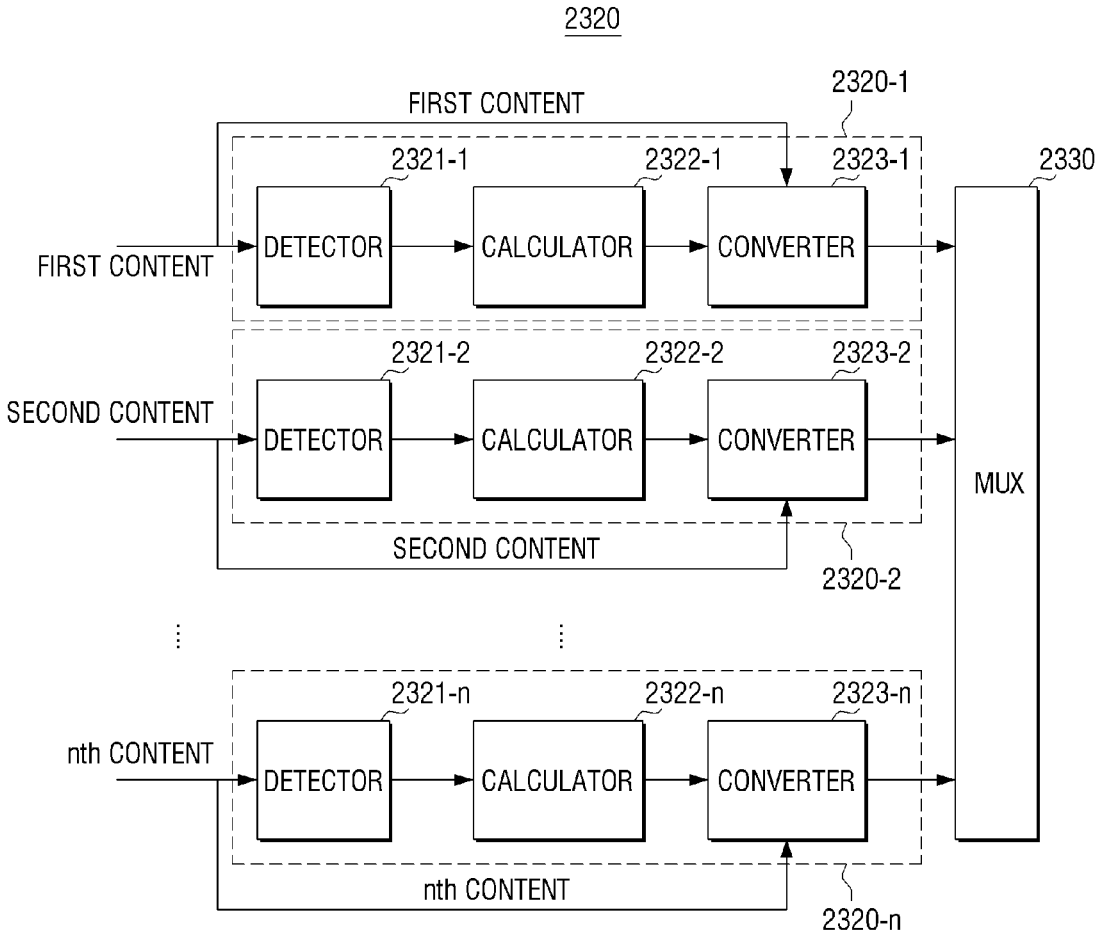
FIG. 26 is a block diagram which illustrates a detailed structure of an image processor according to an exemplary embodiment.

FIG. 26 is a block diagram which illustrates detailed structures of the image processors 2320-1, 2320-2, . . . , and **2320-*n*** according to an exemplary embodiment.

Referring to FIG. 26, each respective one of the plurality of image processors 2320-1, 2320-2, . . . , and **2320-*n* respectively includes a corresponding one of a plurality of detectors 2321-1, 2321-2, . . . , and 2321-*n*, a corresponding one of a plurality of calculators 2322-1, 2322-2, . . . , and 2322-*n*, and a corresponding one of a plurality of converters 2323-1, 2323-2, . . . , 2323-*n***.

The first detector 2321-1 detects brightness information relating to an image frame of a first content.

In detail, the first detector 2321-1 detects an image representative value, i.e., a mean value, of the image frame of the input first content.

The first calculator 2322-1 calculates a brightness adjustment gain having a size corresponding to brightness information relating to the image frame of the first content detected by the first detector 2321-1.

In detail, the first calculator 2322-1 calculates an adaptive brightness limiter (ABL) gain which is applied to the mean value detected by the first detector 2321-1.

For example, if the mean value of the image frame is 255, a gain value may be calculated as 0.5. If the mean value is 50, the gain value may be calculated as 1. In particular, the gain value may be set based on a preset mapping value.

In an exemplary embodiment, an ABL represents one of a plurality of image level automatic adjustment methods for lowering a pixel level of a whole screen on a bright screen and maintaining a pixel level of a whole screen on a dark screen to lower maximum power consumption. In particular, the ABL has been exemplarily described, and the same method may be applied to an adaptive picture level control (APC).

The first converter 2323-1 adjusts a brightness of a corresponding image frame based on the brightness adjustment gain calculated by the first calculator 2322-1. For this purpose, the first converter 2323-1 receives the image frame of the first content received by the first detector 2321-1.

In detail, the first converter 2323-1 multiplies the image frame of the first content by the brightness adjustment gain calculated by the first calculator 2322-1 to adjust the brightness of the corresponding image frame. For example, if the mean value of the image frame is 255 and the calculated gain value is 0.5, 255 is multiplied by gain value 0.5 to make 127. If the mean value of the image frame is 50 and the calculated gain value is 1, 50 is multiplied by gain value 1 to maintain an original gradation on a dark screen.

According to another exemplary embodiment, the first image processor 2320-1 may calculate a representative value of a previous image frame, calculate a gain value corresponding to the calculated representative value, and use the calculated gain value to adjust a brightness of a current image frame. For example, the first image processor 2320-1 may calculate a gain value of an input image pixel of a current image frame and average calculated gain values of previous image frames to calculate a gain value of the current image frame.

The second through nth detectors 2321-2, 2321-3, . . . , **2321-*n*, the second through nth calculators 2322-2, 2322-3, . . . , 2322-*n*, and the second through nth converters 2323-2, 2323-3, . . . , 2323-*n*** may respectively perform the same operations with respect to the image frames of the second through nth contents.

Each of image frames of a plurality of contents for which a respective brightness has been adjusted by using the above-described method may be inputted into the MUX 2330. An operation of the MUX 2330 is as described above, and thus its detailed description will be omitted herein.

Although not shown in the drawings, the plurality of image processors 2320-1, 2320-2, . . . , and **2320-*n*** may include video processors (not shown) and frame rate converters (not shown).

The video processors perform signal processing with respect to video data included in received contents. In detail, the video processors may include decoders (not shown) which decode the video data and scalers (not shown) which perform up-scaling or down-scaling based on a screen size of the display unit 2340.

The video processors may convert the video in a data format which corresponds to the frame rate converters. For example, the video processors may connect image frames of contents side by side in a horizontal direction to convert the image frames in a side-by-side format.

The frame rate converters convert frame rates of contents provided from the video processors based on multi-content display rates with reference to an output rate of the image display device 2300. In detail, if the image display device 2300 operates at 60 Hz, the frame rate converters may convert the frame rates of the contents to n×60 Hz.

Figure 27:
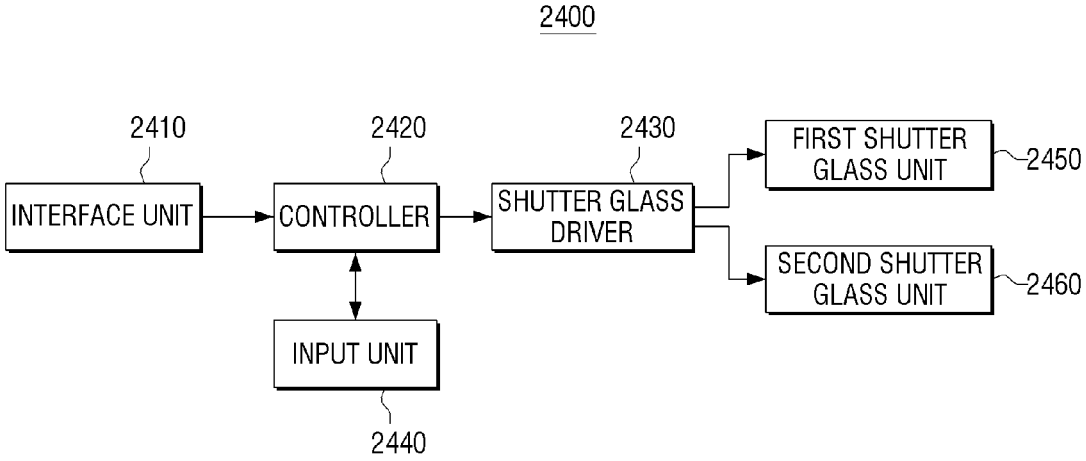
FIG. 27 is a block diagram which illustrates a structure of eyeglass device according to an exemplary embodiment.

FIG. 27 is a block diagram which illustrates a structure of an eyeglass device 2400 according to an exemplary embodiment.

Referring to FIG. 27, the eyeglass device 2400 operates along with the image display device 2300 of FIG. 25A or 25B which alternately displays a plurality of contents in an image frame unit. The eyeglass device 2400 includes an interface unit 2410, a controller 2420, a shutter glass driver 2430, an input unit 2440, a first shutter glass unit 2450, and a second shutter glass unit 2460.

The interface unit 2410 receives a sync signal from the image display device 2300.

For example, if the interface unit 2410 is realized as a Bluetooth communication module, the interface unit 2410 communicates with the image display device 2300 in accordance with Bluetooth communication standards and receives a transmission stream which includes the sync signal. In this case, the transmission stream includes time information which synchronizes with a display timing of each content to turn on or off the first and second shutter glass units 2450 and 2460 of the eyeglass device 2400. The eyeglass device 2400 turns on or off shutter glasses based on a display timing corresponding to the eyeglass device 2400.

The interface unit 2410 may be realized as an IR receiver module to receive an IR form sync signal having a particular frequency. In this case, the IR form sync signal includes time information which is used to turn on or off the first and second shutter glass units 2450 and 2460 of the eyeglass device 2400 such that the first and second shutter glass units 2450 and 2460 synchronize with a display timing of one of a plurality of contents.

The interface unit 2410 receives information relating to an image frame rate and an image frame period of each content from the image display device 2300.

The controller 2420 controls an overall operation of the eyeglass device 240. In particular, the controller 2420 controls an operation of the shutter glass driver 2430 based on the received sync signal. In particular, the controller 2420 controls the shutter glass driver 2430 to turn on/off the first and second shutter glass units 2450 and 2460 based on the sync signal received via the interface unit 2410.

The shutter glass driver 2430 opens the first and second shutter glass units 2450 and 2460 based on a display timing of one of a plurality of contents displayed on the display device 2300 under control of the controller 2420.

The first and second shutter glass units 2450 and 2460 are turned on/off based on a driving signal received from the shutter glass driver 2430. In detail, the first and second shutter glass units 2450 and 2460 are opened when one of a plurality of contents is displayed and are simultaneously closed when another content is displayed. Therefore, a user who wears the eyeglass device 2400 views only one content.

If a 3D content is displayed, the first and second shutter glass units 2450 and 2460 may be alternately opened and closed. In particular, based on the driving signal, the first shutter glass unit 2450 is opened at a timing when a left eye image constituting a 3D content is displayed, and the second shutter glass unit 2460 is opened at a timing when a right eye image of the 3D content is displayed.

The input unit 2440 receives various types of user commands.

In detail, the input unit 2440 receives a pairing command which is used to perform pairing with the image display device 2300, a content view change command, a mode setup command which is used to set a private or public mode, a command which is used to set a 3D mode or a dual view mode, and/or any other relevant type of user command.

For example, the input unit 2440 may be realized as at least one of a touch sensor, a control button, and a slide switch.

If the content view change command is received, the controller 2420 controls the shutter glass driver 2430 to sequentially turn on/off the first and second shutter glass units 2450 and 2460 based on the sync signal received from the image display device 2300.

If the private mode or the public mode is selected, the controller 2420 controls to transmit a user command complying with the corresponding mode to the image display device 2300.

Figure 28A:
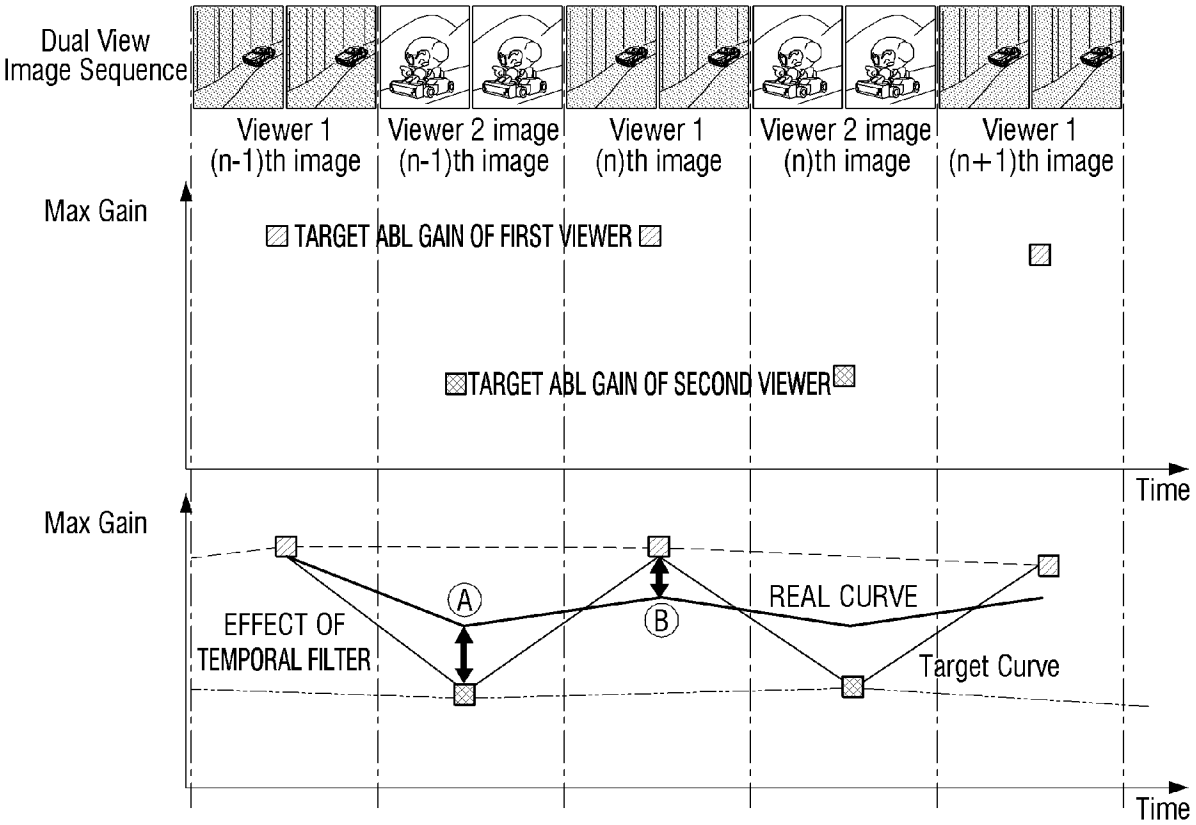
FIGS. 28A and 28B are views comparing a brightness adjusting effect which is produced in accordance with one or more exemplary embodiments with a conventional brightness adjusting effect.
Figure 28B:
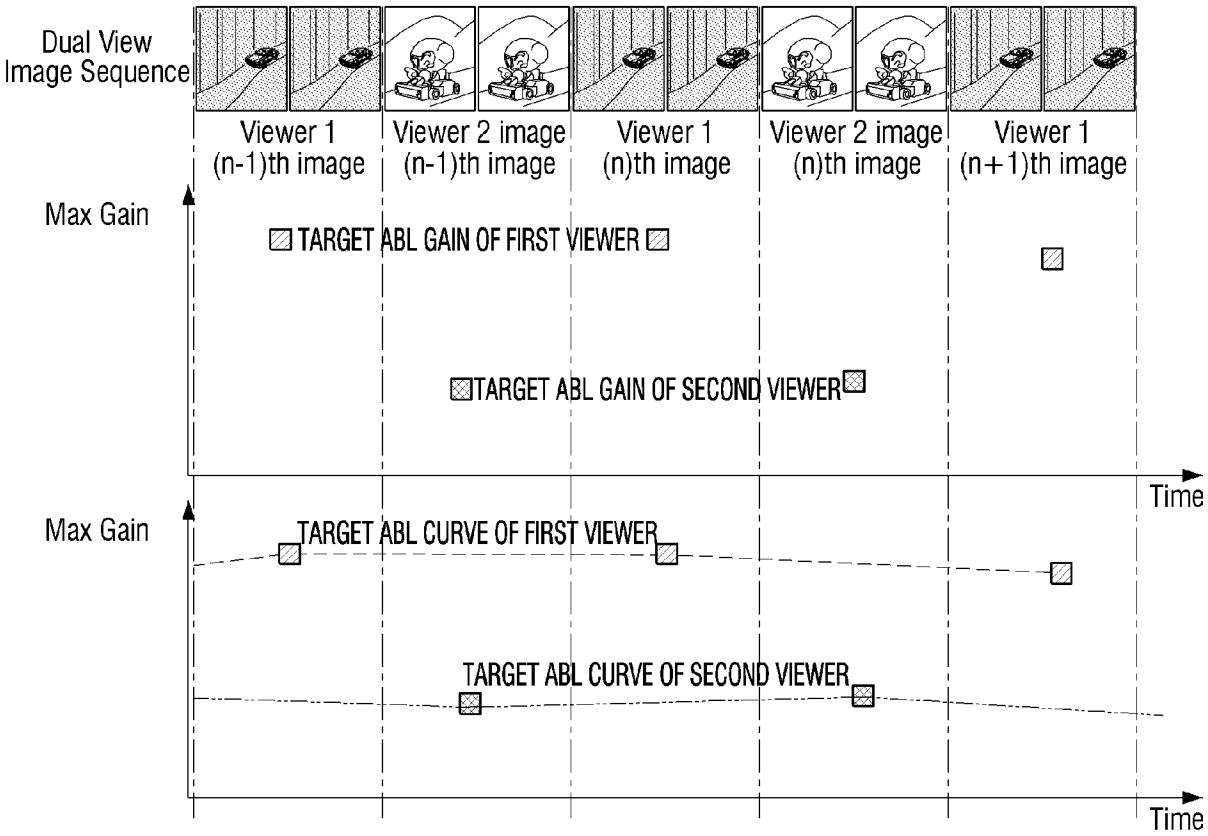

FIGS. 28A and 28B are views which illustrate a comparison between a brightness adjustment effect according to one or more exemplary embodiments and a conventional brightness adjustment effect.

Referring to FIGS. 28A and 28B, first and second viewers respectively view content images having great brightness differences.

FIG. 28A is a view which illustrates the conventional brightness adjustment effect.

As shown in FIG. 28A, the content image viewed by the first viewer is a content image which has a low brightness and to which a high gain is to be applied. The content image viewed by the second viewer is a content image which has a high brightness and to which a low gain is to be applied. However, a gain does not reach a target value due to an effect of a temporal filter of an ABL (or APC) technique, and thus normal brightness is not displayed, and a switched-mode power supply (SMPS) load is great. In detail, the gain of the content image viewed by the second viewer does not fall to the target value, and the gain of the content image viewed by the first viewer does not rise to the target value.

If necessary, the ABL (or APC) technique is not applied. Therefore, a switching driving voltage fluctuates in each image frame even in an operation such as a target curve. As a result, an image-quality realization problem such as a flicker phenomenon may occur.

FIG. 28B is a view which illustrates the brightness adjustment effect of one or more exemplary embodiments.

As shown in FIG. 28B, if an ABL (or APC) technique is applied to each content, an ABL gain is calculated in a normal range.

In detail, target ABL gains of content images viewed by the first viewer are connected to form a target ABL curve of the first viewer. Target ABL gains of contents images viewed by the second viewer are connected to a target ABL curve. Therefore, a normal image quality and a brightness are easily realized.

Figure 29:
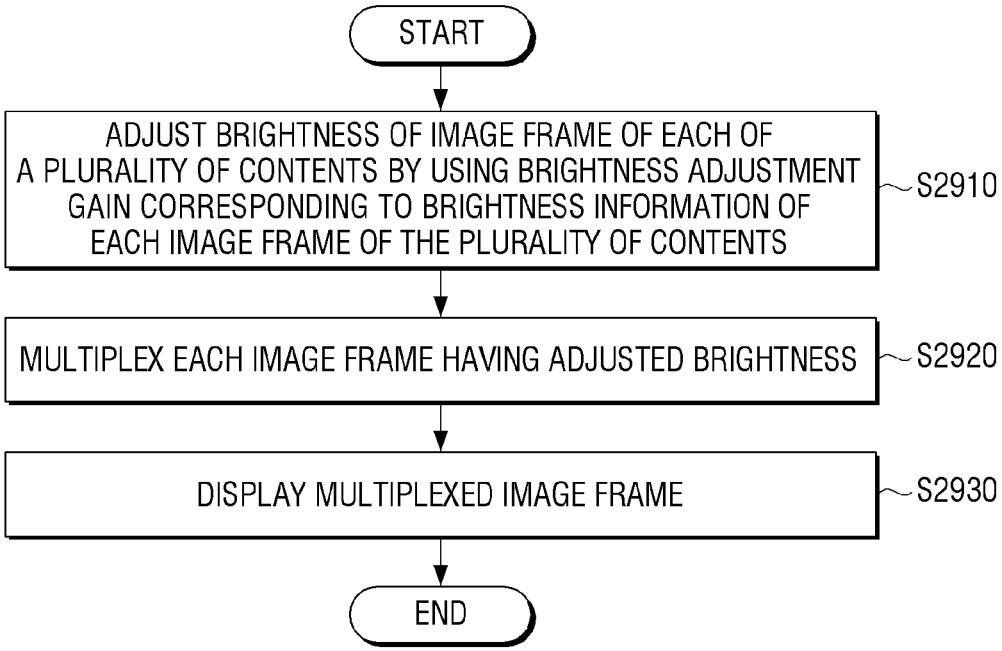
FIG. 29 is a flowchart which illustrates a method for adjusting brightness of contents according to an exemplary embodiment.

FIG. 29 is a flowchart which illustrates a method for adjusting content brightness of an image display device according to an exemplary embodiment.

Referring to FIG. 29, in operation S2910, a brightness of an image frame of each of a plurality of contents is adjusted by using a respective brightness adjustment gain corresponding to brightness information relating to each of the image frames of the plurality of contents.

In operation S2920, each of the image frames having the adjusted brightness is multiplexed.

In operation S2930, the multiplexed image frame is displayed.

Before operation S2910, the method may further include an operation of receiving the plurality of contents, which have been combined in an image frame unit, and dividing the image frames of the plurality of contents.

In particular, operation S2910 may include detecting the brightness information relating to each of the image frames of the plurality of contents, calculating the respective brightness adjustment gain having a size corresponding to the detected brightness information, and adjusting the brightness of the corresponding image frame based on the calculated respective brightness adjustment gain.

Further, in operation S2910, the brightness of the image frame of each of the plurality of contents may be adjusted based on at least one of an ABL and an APC.

In addition, in operation S2930, the multiplexed image frame may be displayed by using a plurality of self-light-emitting display devices. In particular, the self-light-emitting display devices may be realized as OLEDs.

These exemplary embodiments are as described above, and thus their repeated descriptions and illustrations will be omitted.

A program for performing the methods according to the above-described various exemplary embodiments may be stored and used on various types of recording media.

In detail, a code for performing the above-described methods may be stored on various types of terminal-readable recording media such as a random access memory (RAM), a flash memory, a read only memory (ROM), an erasable programmable ROM (EPROM), an electronically erasable and programmable ROM (EEPROM), a register, a hard disk, a removable disk, a memory card, a USB memory, a CD-ROM, and/or any other suitable non-transitory or transitory medium.

The foregoing exemplary embodiments and advantages are merely exemplary and are not to be construed as limiting. The present disclosure can be readily applied to other types of apparatuses. Further, the description of the exemplary embodiments is intended to be illustrative, and not to limit the scope of the claims, and many alternatives, modifications, and variations will be apparent to those skilled in the art.

What is claimed is:

1. A device for displaying an image, the device comprising:

a pixel value converter which receives a plurality of color pixel values of the image and converts the plurality of the received color pixel values;

a display panel which comprises a plurality of color light-emitting devices and drives the plurality of color light-emitting devices according to the plurality of the converted color pixel values;

a light-emission controller which provides the display panel with a control signal which variably controls driving times of the plurality of color light-emitting devices according to colors of the plurality of color light-emitting devices; and a controller which controls the light-emission controller to variably adjust a duty ratio of said control signal according to colors of the plurality of color light-emitting devices based on the plurality of the converted color pixel values, wherein the controller controls the light-emission controller to control first color light-emitting devices by a first duty ratio and to control second color light-emitting devices by a second duty ratio.

2. The device of claim 1, wherein:

the plurality of color light-emitting devices comprise red (R), green (G), and blue (B) light-emitting devices; and the plurality of color pixel values comprise R, G, and B pixel values.

3. The device of claim 1, wherein the pixel value converter stores the converted color pixel values in conjunction with the corresponding received color pixel values in a lookup table (LUT) form.

4. The device of claim 1, wherein the controller comprises:

a conversion value calculator which calculates differences between the received color pixel values and the corresponding converted color pixel values.

5. The device of claim 1, wherein the light-emission controller adjusts the duty ratio of said control signal so that the color light-emitting devices have a long turn-on time in correspondence with an order of a driving voltage of the color light-emitting devices.

6. The device of claim 5, wherein if the color light-emitting devices are R, G, and B color light-emitting devices, the light-emission controller generates said control signal so that the turn-on times satisfy an equation expressible as:

$$ix_org \times Dx_org = ix_calc \times Dx_calc$$

wherein ix_org denotes a current value corresponding to a received pixel value, Dx_org denotes a turn-on time corresponding to the received pixel value, ix_calc denotes a current value calculated by the controller, Dx_calc denotes a turn-on time calculated by the controller, and x can be equal to each of R, G, and B.

7. The device of claim 1, wherein the color light-emitting devices are driven by a same power supply voltage.

8. The device of claim 1, wherein the display panel further comprises:

a first switching element which is supplied with a power supply voltage to generate a current by using the converted color pixel values; and a second switching element which adjusts an amount of the current according to said control signal having the adjusted duty ratio and supplies the adjusted current to the color light-emitting devices.

9. The device of claim 1, wherein conversion degrees of the converted color pixel values are determined according to degrees of lowering and setting a voltage of a switching element connected between the power supply voltage and the color light-emitting devices.

10. A method for displaying an image, the method comprising:

receiving a plurality of color pixel values of an image, converting the plurality of the received color pixel values and outputting the plurality of the converted color pixel values;

driving a plurality of color light-emitting devices according to the plurality of the converted color pixel values, by a display panel;

providing, by a light-emission controller, to the display panel, a control signal which controls driving times of the plurality of the color light-emitting devices; and controlling the light-emission controller to variably adjust a duty ratio of said control signal according to colors of the plurality of color light-emitting devices based on the plurality of the converted color pixel values, wherein the controlling comprises controlling the light-emission controller to control first color light-emitting devices by a first duty ratio and controlling second color light-emitting devices by a second duty ratio.

11. The method of claim 10, wherein the outputting includes outputting the converted color pixel values in conjunction with the corresponding received color pixels, and the method further comprises storing the outputted converted color pixel values and the received color pixel values in a LUT form.

12. The method of claim 11, wherein if the color light-emitting devices are R, G, and B color light-emitting devices, the light-emission controller generates said control signal so that the turn-on times satisfy an equation expressible as:

$$ix_org \times Dx_org = ix_calc \times Dx_calc$$

wherein ix_org denotes a current value corresponding to a received pixel value, Dx_org denotes a turn-on time corresponding to the received pixel value, ix_calc denotes a current value calculated by the controller, Dx_calc denotes a turn-on time calculated by the controller, and x can be equal to each of R, G, and B.

13. The method of claim 10, wherein the converting comprises:

calculating differences between the received color pixel values and the converted color pixel values, wherein the light-emission controller generates said control signal which variably controls the driving times according to colors of the plurality of color light-emitting devices based on the calculation result.

14. The method of claim 10, wherein the controlling of the light-emission controller includes adjusting the duty ratio so that the color light-emitting devices have a long turn-on time in correspondence with an order of a driving voltage of each of the color light-emitting devices.

15. The method of claim 10, wherein the color light-emitting devices are driven by a same power supply voltage.

* * * * *